US006033831A

United States Patent [19]

Ikeda et al.

[11] Patent Number: 6,033,831

[45] Date of Patent: Mar. 7, 2000

[54] METHOD FOR FORMING METHOD

[75] Inventors: Tsuyoshi Ikeda; Takahiko Nojima, both of Hino, Japan

[73] Assignee: Konica Corporation

[21] Appl. No.: 09/293,747

[22] Filed: Apr. 16, 1999

[30] Foreign Application Priority Data

Apr. 24, 1998 [JP] Japan ..... 10-115055

[51] Int. Cl.[7] ..... G03C 7/407

[52] U.S. Cl. ..... 430/363; 430/373

[58] Field of Search ..... 430/363, 373

[56] References Cited

U.S. PATENT DOCUMENTS 5,227,282 7/1993 Tanaka et al. ..... 430/505

*Primary Examiner*—Hoa Van Le
*Attorney, Agent, or Firm*—Jordan B. Bierman; Bierman, Muserlian and Lucas

[57] ABSTRACT

A method for forming an image is disclosed. The method comprises the steps of exposing a photographic image forming medium by scanning by a light beam, and developing the photographic image forming medium to form an image, wherein the diameter and the intensity of light beam are controlled so that the diameter and the intensity satisfy the following relations (1), (2) and (3) within the range of the reflection optical density of an image to be formed after developing of from larger than 0.8 to 3.0;

(1) the value of $\alpha$ is substantially the same as the value of $\beta$ when $\alpha = I_{d1} \times D_{d1}^{2}$ and $\beta = I'_{d1} \times D_{0.8}$, and (2) $D_{d1} < D_{0.8}$ (3) $(D_{d2} - D_{d1})/(d_{2-1}) < 0$ wherein $I_{d1}$ and $D_{d1}$ are each intensity and diameter of light beam to form an image having relection optical density of $d_1$; $D_{0.8}$ is the diameter of light beam to form an image having density of 0.8; $I'_{d1}$ is intensity of the light beam to form an image having a density of d1 when the diameter of the light beam is fixed at $D_{0.8}$; $d_1$ is reflection optical density of image of larger than 0.8 and not larger 3.0 and $d_2$ is reflection optical density of image of larger than $d_1$ and not larger than 3.0.

9 Claims, No Drawings

METHOD FOR FORMING METHOD

FIELD OF THE INVENTION

This invention relates to a method for exposing by which a sharp image can be formed by scanning exposure according to information recorded in a recording medium such as a magnetic recording medium, an exposure method with a high stability against the environmental temperature, and a method for forming an image using such the exposure method and a silver halide photographic light-sensitive material to be used in the image forming method.

BACKGROUND OF THE INVENTION

Recently, a demand for outputting an image from the image information recorded in a magnetic recording medium is raised not only in the field of printing but in the general public accompanied with spread of a digital camera. Various methods such as a thermal transfer method, an ink-jet method and an electronic photographic method are practically used for responding such the demand. In this field, a method in which an image is obtained by scanning a silver halide photographic light-sensitive material with a laser light beam generated from a semiconductor laser or a laser diode (LED) is widely used because of the plentiful gradation of the silver halide photographic light-sensitive material. Such the method is more widely used since the scanning exposure by visible light is realized as a result of recent progress of a semiconductor laser or a wavelength converting element using a non-linear optical material.

However, the exposure time is extremely shorter and the light intensity is higher in the scanning exposure than those in the printing method through a negative film used in an ordinary mini-lab.

Accordingly, it is required that a natural image can be obtained by the scanning exposure with a laser light beam.

Moreover, in such the image forming method, it is also required that the dependency of characteristics of the photographic paper on the environmental condition is made smaller, such the property is also required to usual photographic paper. A technology for raising the stability of image is disclosed in Japanese Patent Publication Open to Public Inspection (JP O.P.I.) No. 5-19423 in which the stability of image can be obtained by overlapping a scanning line with the neighboring scanning line in a specific ratio. An image forming method is disclosed in JP O.P.I. No. 323521 in which a silver halide photographic light-sensitive material which reflects light in a ratio of not more than 30% of incident light, is exposed by scanning with light generated from a light source capable of being changed the light intensity to multi-steps for a exposing time of not more than $10^{-7}$ seconds per pixel.

The publication describes that a simple rapid processing is realized and the different of density and color between the pictorial image and the character or fine line can be reduced in such the technique. Moreover, JP O.P.I. No. 6-214351 discloses a method in which a rapid processing can be applied and a high quality image with a small unevenness density can be obtained by use of a laser light beam which is generated under a condition controlled at a temperature and the wavelength of light of the laser beam and the spectral sensitivity distribution has a specific relation, and the width of peak of spectral sensitivity is within a specific range.

However, these technologies are insufficient to obtain a naturally modulated image with high sharpness and contrast, since the stability of a high density image and that a low density image are different from each other with respect to a variation of temperature at the exposing, as a result of that a unnatural image is formed.

As the means for attaining the purpose of stably obtaining an image and that of raising the gradation of image for making a natural image, the use of a light-sensitive material in which a mixture of silver halide emulsions each having substantially the same spectral sensitivity and forming substantially the same chroma and different from each other in the sensitivity thereof are used, or a light-sensitive material which has a plural silver halide emulsion layers each having substantially the same spectral sensitivity and forming substantially the same chroma and different from each other in the sensitivity thereof are used, has be known. For example, JP O.P.I. 61-116350 discloses a method to obtain a suitable silver halide photographic light-sensitive material by using a mixture of at least two kinds of emulsion which have each a substantially the same average grain diameter and contain different amount of sensitizing dye and have relative sensitivity different 25% or more from each other.

Japanese Patent Publication No. 63-38693 discloses a method by which the gradation within the range of from 0.8 to 3.0 is raised by the use of a silver halide photographic light-sensitive material for laser light beam exposure which contains silver halide emulsions each having a specific grain diameter different from each other, in a specific ratio, and is hardened in a specific degree.

These methods are still insufficient to obtain a sharp and naturally modulated image with high contrast. JP O.P.I. No. 9-171237 discloses a technology of a photographic element having a property suitable for exposing for less than 50 microsecond. According to the technology, the photographic element has a specific range of $\gamma$ value, and the sharpness is improved when the exposure is made by scanning with laser light beam.

However, the gradation is not suitable and a natural image cannot be obtained when the photographic element using such the technology is used as a photographic element for printing an image through negative film according to usual method even though the sharpness can be improved when the photographic element is exposed to scanning by laser light beam. Accordingly, it is found that the image formation by the scanning exposure by laser light beam is not compatible with the image formation by exposure through a negative film.

On the other hand, JP O.P.I. Nos. 3-192346 and 4-276730 disclose a technology for improving the reciprocity low failure of silver halide photographic light-sensitive material by a fundamental technology in which a mixture of two or more kinds of emulsion which are different 40% or more from each other in the content of iridium. Moreover, JP O.P.I. No. 4-276739 discloses a black-and-white light-sensitive material improved in the pressure defect in which contains two or more kinds of emulsion different in the grain diameter from each other and the larger grains contain a larger amount of iridium.

However, these technologies are insufficient to obtain a high quality image by scanning exposure by a laser light beam, in concrete, the compatibility of sensitivity and the stability of property with respect to using environment namely the variation of sensitivity depending on the variation of time between the exposure and the processing. As a result of that a high quality image cannot be stably obtained.

SUMMARY OF THE INVENTION

The object of the invention is to provide an exposing method capable of forming a sharp image by scanning exposure according to soft image information recorded by a recording medium such as a magnetic recording medium, an exposing method having a high stability with respect to the environmental temperature, an image forming method using the exposing method, and a silver halide photographic light-sensitive material to be used in the image forming method, particularly, an image forming method by which a high quality image having a high sharpness and contrast and a suitably modulated gradation by scanning exposing with a laser light beam, and image forming method by which an image can be obtained stably with a reduced influence by the variation of environmental condition such as the time between the exposure and the processing and the temperature at the exposure, and a silver halide light-sensitive material to be used in such the method and also to be usable in a usual image forming method by exposure through a negative film.

The object of the invention is attained by a method for forming an image comprising the steps of exposing a photographic image forming medium by scanning by a light beam, and developing the photographic image forming medium to form an image, wherein the diameter and the intensity of light beam are controlled so that the diameter and the intensity satisfy the following Relations (1), (2) and (3) within the range of the reflection optical density of an image to be formed after developing of from larger than 0.8 to 3.0;

(1) the value of $\alpha$ is substantially the same as the value of $\beta$ when $\alpha=I_{d1}\times D_{d1}^2$ and $\beta=I'_{d1}\times D_{0.8}$, and (2) $D_{d1}<D_{0.8}$ (3) $(D_{d2}-D_{d1})/(d_2-d_1)<0$ wherein $I_{d1}$ and $D_{d1}$ are each intensity and diameter of light beam to form an image having relection optical density of $d_1$; $D_{0.8}$ is the diameter of light beam to form an image having density of 0.8; $I'_{d1}$ is intensity of the light beam to form an image having a density of $d_1$ when the diameter of the light beam is fixed at $D_{0.8}$; $d_1$ is reflection optical density of image of larger than 0.8 and not larger 3.0 and $d_2$ is reflection optical density of image of larger than $d_1$ and not larger than 3.0.

DETAILED DESCRIPTION OF THE INVENTION

In the invention, an image is formed on a photographic image forming medium by scanning by a libeam, and the light intensity and the diameter of the light beam satisfy the following relations within the range of the reflection optical density of image to be formed after developing of from larger than 0.8 to 3.0;

(1) the value of $\alpha$ is substantially the same as the value of $\beta$ when $\alpha=I_{d1}\times D_{d1}^2$ and $\beta=I'_{d1}\times D_{0.8}$, and (2) $D_{d1}<D_{0.8}$ (3) $(D_{d2}-D_{d1})/(d_2-d_1)<0$ wherein $I_{d1}$ and $D_{d1}$ are each intensity and diameter of light beam to form an image having relection optical density of $d_1$; $D_{0.8}$ is the diameter of light beam to form an image having density of 0.8; $I'_{d1}$ is intensity of the light beam to form an image having a density of $d_1$ when the diameter of the light beam is fixed at $D_{0.8}$; $d_1$ is reflection optical density of image of larger than 0.8 and not larger 3.0 and $d_2$ is reflection optical density of image of larger than $d_1$ and not larger than 3.0.

A laser light beam is preferably applied as the light beam and a silver halide photographic light-sensitive material is preferably used as the photographic image forming medium. In the invention, the light intensity of laser beam can be measured by the procedure described in JIS C 6180-1991. The laser light beam intensity in the invention is preferably controlled according to the characteristics of the silver halide photographic light-sensitive material, even though the intensity for obtaining a specific optical reflection density is varied depending on the characteristics of the light-sensitive material to be used. In the invention, the laser light beam intensity is increased accompanied with increasing the optical reflection image density to be formed by the optical reflection density of 0.8. It is preferable that the laser light beam diameter is constant in this region. In the region of the optical reflection density of from 0.8 to 3.0, the laser light beam intensity is controlled so that the intensity and the diameter of the light beam satisfy Relation of (1), (2) and (3) of the invention.

In Relation (I) of the invention, "the value of $\alpha$ and the value of $\beta$ are substantially the same" means that the value of $\alpha/\beta$ is within the range of from 0.9 to 1.1.

The laser light beam diameter in the invention is defined by the diameter at which the light intensity is become $1/e^2$ of the intensity at the peak (e is a base of natural logarithm). The laser light beam diameter can be measured by a known measuring method, for example, by Beam Scan manufactured by Photo Inc. Although the laser light beam diameter may be varied depending on the image density to be formed, a diameter of from 5 to 150 $\mu$m, more preferably 50 to 100 $\mu$m within the range of the image density of less than 0.8. The laser light beam diameter is decided according to Rquations (1), (2) and (3) of the invention in the region of the image density of from 0.8 to 3.0.

The intensity of laser light beam, hereinafter referred to a beam light intensity, and the diameter of the laser light beam, hereinafter referred to a beam diameter, can be controlled by known various methods. The following method is an example the method. Generally, the beam diameter of laser light is in inversely proportional to the diameter of a beam incident to a f$\theta$ lens. The beam diameter of the beam incident to the f$\theta$ lens can be controlled by the width of a slit provided before the laser light source. The laser beam diameter in the invention can be controlled by controlling the width of the slit provided before the laser light source.

In the scanning exposure in the invention, it is preferable that the scanning pitch is smaller than the effective laser beam light diameter and the overlapping width is from 30% to 95% of the effective diameter of laser light beam. The ratio of from 50% to 80% is more preferably for enhancing the effect of the invention. The effective laser light beam is the laser light beam diameter for forming an optical reflection density of 0.8, namely $D_{0.8}$.

Various known light sources can be used as the light source for generating the laser light beam of the invention, and a high intensity light source such as a semiconductor laser, a gas laser and a light emission diode is preferably since it shows a considerable effect. The use of a light emission diode, a semiconductor laser or a second harmonic generation (SHG) composed of a combination of a semiconductor laser and a non-linear optical crystal is preferable.

In the image forming method of the invention, the temperature of the silver halide photographic light-sensitive material at the moment of exposure controlled at a specified temperature within the range of from 30° C. to 100° C. and the allowance of the temperature is ±3° C. The temperature is preferably within the range of from 60° C. to 100° C. To control the temperature of the light-sensitive material, it is preferable to control the temperature of holer on which the light-sensitive material held at the moment of the exposure to light.

The temperature of silver halide photographic light-sensitive material in the invention may be controlled, for example, by a method in which the temperature of the holder firmly holding the silver halide photographic light-sensitive material at the moment of exposure. In the image forming method, it is a preferable embodiment for enhancing the effect of the invention that the temperature along the transporting course of the silver halide photographic light-sensitive material to the exposing holder is the same as the specified temperature or a temperature with in the range to 20° C. less than the specified temperature.

The fundamental γ in the invention is determined as follows. The silver halide photographic light-sensitive is exposed to light for a specified time of not more than $10^{-5}$ second through an optical step wedge having a logarithmic difference of exposure amount between each of the steps of 0.1 and processed. The density of each of thus obtained steps are measured.

Thus measured density is plotted versus logarithmic relative exposure amount to draw a characteristic curve. The maximum density and the minimum density are determined from the characteristic curve, and a logarithmic exposure amount H1 forming a density of (Minimum density)+(Maximum density−Minimum density)×0.25 and a logarithmic exposure amount H2 for forming a density of (Minimum density)+(Maximum density−Minimum density)×0.75 are determined. The fundamental γ is calculated by (Maximum density−Minimum density)×0.5/(H2−H1).

Although the fundamental γ of the silver halide photographic light-sensitive material of the invention is from 1.0 to 3, a value of from 1.5 to 3.0 is preferable to make a high compatibility of image formation by scanning exposure with laser light beam and the image formation by exposure through a negative film.

The silver halide emulsion relating to the invention may have an optional halide composition such as silver chloride, silver bromide, silver chlorobromide, silver iodobromide, silver chloroiodobromide, and silver iodochloride. Silver chlorobromide containing 95 mole-% or more of silver chloride and no silver iodide is preferable. A silver halide emulsion containing 97 mole-%, particularly from 98 to 99.5 mole-%, of silver chloride is preferable from the viewpoint of a suitability to rapid processing and a stability of processing.

As the silver halide emulsion relating to the invention, a silver halide emulsion is preferable which has a portion containing a high concentration of silver bromide. In such the case, the portion containing a high concentration of silver bromide may be a portion epitaxially connected to the silver halide grain, a core/shell type emulsion, or a portion having a different composition which is locally present in the grain without formation of a complete layer. The composition may be varied continuously or discontinuously in the grain. It is particularly preferred that the portion containing a high concentration of silver bromide is positioned at a vertex of the surface of crystal of silver halide grain.

A silver halide photographic light-sensitive material is preferably used in the invention which comprises a reflective support having thereon at least one silver halide emulsion layer containing two or more silver halide emulsions different from each other in the sensitivity thereof. Among these emulsions, two kinds of silver halide emulsion having near sensitivity each contain a metal compound capable of trapping an electron, hereinafter referred to an electron trapping metal compound, and a metal compound capable of trapping a hole, hereinafter referred to a hole trapping metal compound, and the amount of the electron trapping metal compound and the amount of the hole trapping metal compound in each emulsions satisfy Relation (4);

(4) $1 \leqq ((L1)+(L2)\times(RL)^{-3})/((H1)+(H2)\times(RH)^{-3}) \leqq 30$ wherein L1 is a content of the electron trapping metal compound in the lower sensitive emulsion (moles/mole of Ag);

L2 is a content of the hole trapping metal compound in the lower sensitive emulsion (moles/mole of Ag);

RL is an average grain diameter of the lower sensitive emulsion;

H1 is a content of the electron trapping metal compound in the higher sensitive emulsion (moles/mole of Ag);

H2 is a content of the hole trapping metal compound in the higher sensitive emulsion (moles/mole of Ag);

RH is an average grain diameter of the higher sensitive emulsion;

provided that (L1), (L2), (H1) and (H2) are not zero.

The metal compound to be contained in the silver halide emulsion is added to the silver halide emulsion in a form of a salt or a complex salt. The metal compound can be classified into three kinds, an electron trapping metal compound, a hole trapping metal compound and another. The metal compounds to be added to silver halide emulsion are classified into the three groups according to the ratio of attenuation time of photoconductive signal in the induced adsorption in a microwave photo-conductivity measurement in an emulsion containing the metal compound to that in a standard emulsion. The metal compounds having the ratio of from 0 to 0.9 are the electron trapping metal compounds, and those having the ratio of not less than 1.3 are the hole trapping metal compounds, and those having the ratio other than the above-mentioned are the other metal compounds. The microwave photo-conductivity measurement is a method for evaluating physical properties of silver salt photographic emulsion well known in the field of photographic science. The measurement can be performed referring, for example, the method described in L. M. Kellog, "Photographic Science and Engineering" vol. 18, p. 378, 1947. The detail condition of microwave photo-conductivity measurement in the invention is performed according to the description in JP O.P.I. No. 5-45758.

The attenuation time of photoconductive signal in the induced adsorption is measured according to the description in JP O.P.I. No. 8-328178. In the invention EMP-0 described in the later-mentioned Example 1 is used as the standard emulsion. The emulsion to be measured is prepared in the same manner as in EMP-1 of Example 1 except that one kind of metal compound is added to Solution C in an amount of $1\times10^{-6}$ moles/mole of silver.

When plural kinds of electron trapping metal compound or hole trapping metal compound are contained in the emulsion of the invention, the added amount of the electron trapping metal compound is the sum of the amounts of electron trapping metal compounds, and in the case of the hole trapping metal compound, the description of the amount of such the compound is the same as in the case of the electron trapping metal compound.

Although the range of the parameter in Relation (4) is from 1 to 30, a parameter within the range of from 2 to 20 is preferable for enhancing the effects of the invention.

In Relation (4) of the invention, the electron trapping metal compound and the hole trapping metal compound are only subjected among the metal compounds contained in the silver halide emulsion.

Accordingly, a metal compound other than the electron trapping and the hole trapping metal compounds may be added according to another purpose without any relation with Formula (IV).

The grain diameter in Relation (4) can be determined by the projection area of the grain. The grain diameter can be measured by various methods know in the field of photography. the methods described in Loveland "Method Analysis of Grain Diameter" in "A. S. T. M. Symposium on Light Microscopy" p.p. 94–122, 1955, and Mees and James "Theory of the Photographic Process" 3rd Ed. Chapter 2, Macmillan, 1966, are cited as a typical ones.

Although there is no limitation on the diameter of the silver halide grains, a size of from 0.1 to 1.2 $\mu$m is preferable and the size of from 0.2 to 1.0 $\mu$m is more preferable from the viewpoint of photographic properties such as a suitability for rapid processing and a sensitivity.

Preferable metal compound to be contained in the silver halide emulsion preferably usable in the invention includes an ion of metal of Groups VIII to X such as iron, iridium, platinum, palladium, nickel, rhodium, osmium, ruthenium and cobalt, and an ion of transition metal of Group XII such as cadmium, zinc, and mercury, and an ion of lead, rhenium, molybdenum, tungsten, gallium or chromium as a heavy metal ion, and a cyanide ion, thiocyanate ion, cyanate ion, chloride ion, bromide ion, iodide ion, nitrate ion, carbonyl ion and ammonia can be cited as a ligand or a counter ion. Among them, metal ion of iron, iridium, platinum, ruthenium, gallium, Osmium, and a cyanide ion, thiocyanate ion, isothiocyanate ion, chloride ion and bromide ion are preferable.

The metal compound may be added to the emulsion at an optional step of before the formation of silver halide grain, in the course formation of silver halide grains, in the course of physical ripening of the grains after grain formation, to be contained in the silver halide grains. To obtain a silver halide emulsion satisfying the foregoing condition, the heavy metal compound may be dissolved together with a halide salt and continuously added over whole or part of the period of grain forming process. The amount of the metal compound to be added to the silver halide emulsion is preferably from $1\times10^{-9}$ moles to 1 $10^{-2}$ moles, more preferably from $1\times10^{-8}$ moles, per mole of silver halide.

In the silver halide photographic light-sensitive material usable in the invention comprising a reflective support having thereon at least one photographic layer containing two or more kinds of silver halide emulsion substantially different from each other in the sensitivity thereof, the two or more kinds of emulsions different from each other in the sensitivity thereof have the same spectral sensitivity.

Here, "substantially different in the sensitivity" means that the difference of sensitivity of the two kind of emulsions is 10% or more.

The sensitivity of each od the emulsions is defined by a reciprocal of exposure amount forming a prescribed density on a sample which is exposed to light through an optical wedge in an ordinary manner and processed. In the samples, each of the two or more kinds of emulsion is respectively coated on a support in the same amount.

The silver halide photographic light-sensitive material may contain three or more kinds of emulsion. In such the case, the metal compounds in two of the emulsions which are near in the sensitivity satisfy Relation (4). When plural kinds of emulsion are contained, the ratio of two kind emulsions which are near the sensitivity thereof is within the range of from 10:90 to 90:10.

In the invention, silver halide grain having an optional shape is usable. One of preferable example is cubi grain having (100) faces as the surface of crystal. Furthermore, a grain having an octahedral, tetradecahedral or dodecahedral shape can be used which is prepared by the methods described in U.S. Pat. Nos. 4,183,756 and 4,225,666, JP O.P.I. No. 55-26589, Japanese Patent 55-42737 and J. Photogr. Sci., 21, 39, 1973. A grain having a twin surface may be used.

In the invention, known thermal development process can be applied. In the thermal development process, a components necessary for development is supplied by heating. A process to transfer the image to another image receiving element may be provided after the development by heating.

Silver halide grains each having an uniform shape are preferably used in the invention.

The silver halide grains usable in the invention is preferably monodisperse silver halide grains having a grain diameter distribution of not more than 0.15, more preferably not more than 0.15, in the variation coefficient. It is particularly preferable that two or more kinds of monodisperse emulsion each having a variation coefficient of not more than 0.15. The variation coefficient is a parameter expressing the breadth of grain diameter distribution, which is defined by the following equation.

$$\text{Variation coefficient}=S/R$$

wherein S is a standard deviation of the grain diameter distribution and R is an average grain diameter.

The grain diameter is the diameter in the case of a sphere-shaped grain, and the diameter of a circle corresponding to the projection area of a grain in the case of cubic grain or a grain having a shape other than a sphere.

Various devices and methods known in the field of photography may be used for preparation of the silver halide emulsion.

The silver halide emulsion relating to the invention may be one obtained by an acidic method, a neutral method or an ammoniacal method. The grains may be grown at once or brown from previously prepared seed grains. The method for preparing the seed grains may be the same as or different from that for growing the grains.

Although any procedure such as a normal mixing method, a reverse mixing method a double-jet mixing method and a combination thereof may be applicable for reacting, an emulsion prepared by the double-jet method is preferable. The pAg-controlled double-jet method described in JP O.P.I. No. 54-48521 is also usable.

The apparatus described JP O.P.I. Nos. 57-92523 and 57-92524 by which a solution of water-soluble silver salt and a solution of water-soluble halide salt are supplied through a adding device provided in a reaction mother liquid, the apparatus described in German Patent Publication OLS No. 2,921,164 by which a solution of water-soluble silver salt and a solution of water-soluble halide salt are added while the concentration of each of the solutions are continuously varied, and the apparatus described in Japanese Patent No. 56-501776 by which the grains are formed while the distance between the grains is maintained at constant by taking out the reaction mother liquid from the reaction vessel and concentrating the reaction mother liquid by an ultra filtering method, may be used.

A silver halide solvent such as a thioether may further be used if it is necessary. A compound such as a compound having a mercapto group, a nitrogen-containing heterocyclic compound and a sensitizing dye may be added at the step of silver halide grain formation or after completion of grain formation.

A sensitizing method using a gold compound, and that using a chalcogen compound can be applied in combination to the silver halide emulsion relating to the invention.

A sulfur sensitizer, a selenium sensitizer and a tellurium sensitizer may be used as the chalcogen sensitizer for the silver halide emulsion relating to the invention, and the sulfur sensitizer is preferable. The sulfur sensitizer includes a thiosulfate, allylthiocarbamido-thiourea. allylthiocyanate, cystine, p-toluenethiosulfonate, rhodanine and elemental sulfur.

The adding amount of the sulfur sensitizer is preferably within the range of from $5\times10^{-10}$ to $5\times10^{-5}$ moles, more preferably from $5\times10^{-8}$ to $3\times10^{-5}$ moles, per mole of silver halide, even though it is preferable that the amount is changed depending on the kind of silver halide emulsion and an expected effect.

The gold sensitizer usable in the invention may be added in a form of various cold complexes such as chloroauric acid and gold sulfide. As the ligand compound of the complex, a compound such as dimethylrhodanine, thiocyanic acid, mercaptotetrazole and mercaptotriazole is usable. Although the amount of the gold compound is preferably from $1\times10^{-8}$ moles to $1\times10^{-4}$ moles, more preferably from $1\times10^{-8}$ moles to $1\times10^{-5}$ moles, per mole of silver halide, although the amount is not uniform depending on the kind of the silver halide emulsion, the kind of the compound and the ripening condition.

A reduction sensitizing method may be applied for the chemical sensitization of the silver halide emulsion relating to the invention.

A know fog inhibitor or stabilizer can be used in the silver halide emulsion relating to the invention to prevent fog formed in the course of preparation of the silver halide emulsion, reducing the fluctuation of property in the period of storage, and to prevent fogging at the development. Examples of compound preferably usable for such the purposes include a compound represented by Formula (II) described in JP O.P.I. No. 2-146036, lower column of page 7. Concrete examples of the compounds include Compounds (IIa-1) through (IIa-8) and Compounds (IIb-1) through (Iib-7) described in the above publication, 1-(3-methoxyphenyl)-5-mercaptotetrazole and 1-(4-ethoxyphenyl)-5-mercaptotetrazole.

Such the compounds are added at the grain formation process, chemical sensitizing process and the coating solution preparation process of the silver halide grain.

When the chemical sensitization is performed in the presence of such the compound, the compound is preferably used in an amount of from about $1\times10^{-5}$ moles to $5\times10^{-4}$ moles per mole of silver halide. When the compound is added at the completion of chemical sensitization, the amount of the compound is preferably from about $1\times10^{-6}$ moles to $1\times10^{-2}$ moles, more preferably from $1\times10^{-5}$ moles to $5\times10^{-3}$ moles, per mole of silver halide. When the compound is added to the silver halide emulsion layer at the process of coating liquid preparation, the amount of the compound is preferably from about $1\times10^{-6}$ moles to $1\times10^{-1}$ moles, more preferably from $1\times10^{-5}$ moles to $5\times10^{-2}$ moles, per mole of silver halide. Moreover, when the compound is added to a layer other than the silver halide emulsion layer, the amount of in the coated layer is preferably from about $1\times10^{-9}$ moles to $1\times10^{-3}$ moles per square meter.

In the light-sensitive material of the invention, dyes each having a absorption at various wavelength region may be added for various purposes such as anti-irradiation and antihalation. Although any known compound can be used for such the purpose, dyes AI-$_1$ through AI-11 described in JP O.P.I. No. 3-251840, 308 page, and the dyes described in JP O.P.I. No. 6-3770 are preferably used as the dye having absorption in the visible region. As infrared absorbing dyes, compounds represented by Formulas (I), (II) or (III) described in JP O.P.I. No. 1-280750 are preferable since they have a suitable optical property, do not influence on the photographic property of the silver halide photographic emulsion, and do not cause stain by the remaining color. Examples of preferable compound include exemplified compounds (1) through (45) described in JP O.P.I. No. 1-280750, page 3, lower left column, through page 5, lower left column.

The amount of these dyes is preferably a amount so as to make the optical reflection density of light-sensitive material before processing to not less than 0.7, more preferably not less than 0.8.

It is preferable to add a fluorescent whitening agent into the light-sensitive material to improve the whiteness of the background. Preferable compounds include ones represented by Formula II described in JP O.P.I. No. 2-232652.

When the light-sensitive material of the invention is used as a color photographic material, the light-sensitive material has emulsion layers respectively contains a yellow, magenta or cyan color forming coupler and spectrally sensitized in a specified wavelength region within the range of from 400 to 900 nm. The emulsion layer may contain one or more kinds of sensitizing dye.

Although any known compounds are usable as the spectral sensitizing dye to be added to the silver halide emulsion relating to the invention, BS-1 through BS-8 described in JP O.P.I. No. 3-251840, page 28, are preferably used singly or in combination as blue-sensitizing dyes. GS-1 through GS-4 described in the same publication are preferably usable as green-sensitizing dyes. RS-1 through RS-8 described on page 29 of the same publication are preferably usable as red-sensitizing dyes.

When the imagewise exposure is given by infrared rays using a laser, use of an infrared sensitizing dye is necessary. Dyes IRS-1 through IRS-11 described on pages 6-8 of JP O.P.I. No. 4-285950 are preferably used.

These infrared-, red-, green- and blue-sensitizing dyes are preferably used together with the supersensitizer SS-1 through SS-9 described on pages 8–9 and the compounds S-1 through S-17 described on pages 15–17 if JP O.P.I. No. 5-66515.

These sensitizing dyes may be added at an optional process of from the formation of silver halide grain to the completion of chemical sensitization.

The sensitizing dye may be added in a form of solution in a water-miscible solvent such as methanol, ethanol, fluorinated alcohol, acetone and dimethylformamide, or water, or in a form of dispersion of solid particles.

Any compound capable of forming a coupling product having a spectral absorption at a wavelength region of hot shorter than 340 nm by reaction with the oxidation product of a color developing agent can be used as the coupler to be used in the silver halide photographic light-sensitive material of the invention. Compounds know as a yellow dye-forming coupler having a maximum spectral absorption at a wavelength of from 350 nm to 500 nm, a magenta dye-forming coupler having a maximum spectral absorption at a wavelength of from 500 nm to 600 nm, a cyan dye-forming coupler having a maximum spectral absorption at a wavelength of from 600 nm to 750 nm are typical.

Cyan couplers preferably usable in the light-sensitive material of the invention include the couplers represented by Formula (C-I) or Formula (C-II) described in JP O.P.I. No. 4-114154, page 5, lower left column. Concrete compounds include CC-1 through CC-9 described on page 5, lower right column to page 6, left lower column, of the same publication.

Magenta couplers preferably usable in the light-sensitive material of the invention include the couplers represented by Formula (M-I) or Formula (M-II) described in JP O.P.I. No. 4-114154, page 4, upper right column. Concrete compounds include MC-1 through MC-11 described on page 4, upper right column, to page 5, upper right column, of the same publication. Among them, one represented by Formula (M-I) in which RM is a tertiary alkyl group is preferable since such the coupler is excellent in the light-fastness. C-8 through C-11 described on page 5, upper column are preferable since such the coupler is excellent in the color reproducibility in the region of from blue to purple and red and in the reproducibility of detail of image.

Yellow couplers preferably usable in the light-sensitive material of the invention include the couplers represented by Formula (Y-1) described in JP O.P.I. No. 4-114154, page 3, upper right column. Concrete compounds include YC-1 through YC-9 described on page 3, left lower column, of the same publication. Among them, ones represented by Formula [Y-1] in the same publication in which RY1 is an alkoxy group, and the couplers represented by Formula [I] described in JP O.P.I. No. 6-67388 are preferable since such the couplers can reproduce a preferable yellow color tone.

Examples of particularly preferable compound include YC-8 and YC-9 described in JP O.P.I. No. 4-114154, page 4, lower left column, and Compounds Nos. (1) to (47) described in JP O.P.I. No. 6-67388, pages 13–14. The most preferable compounds are those represented by Formula [Y-1] described in JP O.P.I. No. 4-81847, page 1 and pages 11 to 17.

When a oil-in-water type dispersion method is applied for adding the couplers or another organic compound into the silver halide photographic light-sensitive material, the coupler of the other compound are dissolved in a water-insoluble high-boiling point organic solvent having a boiling point of not less than 150° C. and dispersed using a surfactant in an aqueous solution of a hydrophilic binder such as gelatin. A low-boiling point organic solvent and/or a water-miscible organic solvent are used together with the high boiling point organic solvent if they are necessary. A stirrer, a homogenizer, a colloid mil or an ultrasonic dispersing can be used as a dispersing means. A process for removing the low-boiling point organic solvent after or at the same time of the dispersion may be provided. A phthalate such as dioctyl phthalate, diisodecyl phthalate, dibutyl phthalate and a phosphate such as tricresyl phosphate and trioctyl phosphate are preferably used as the high-boiling point solvent for dissolving and dispersing the coupler. The dielectric constant of the high-boiling point organic solvent is preferably from 3.5 to 7.0, and two or more kinds of the high-boiling point organic solvent may be used in combination.

A method can be applied in which a water-insoluble and organic solvent-soluble polymer are used in place of or together with the high-boiling point organic solvent. The polymer is dissolved in a low-boiling point organic solvent and/or water-miscible organic solvent according to necessity, and dispersed using a surfactant in an aqueous solution of a hydrophilic binder such as gelatin. An example of the water-insoluble and organic solvent-soluble polymer is poly(N-t-butylacrylamide).

A compound which has a hydrophilic group having 8 to 30 carbon atoms and a sulfonic acid group or it salt in the molecule thereof is preferably used as the surfactant to be used for dispersing the photographic additive or controlling the surface tension of the coating solution at the coating. Concrete examples of such the compound include A-1 through A-11 described in JP O.P.I. No. 64-26854. A surfactant which has an alkyl group having a fluorine atom as the substituent is also preferably used. The dispersion is usually added to a coating liquid which contains the silver halide emulsion. The duration from the dispersing to the addition of the dispersion to the coating liquid and that from the addition to the coating liquid to coating of the liquid are each preferably shorter and preferably not more than 10 hours, more preferably not more than 3 hours, particularly preferably not more than 20.

A discoloration preventing agent is preferably used together with the foregoing couplers for preventing the discoloration of dye image caused by light, heat and moisture. Particularly preferable compounds for a magenta dye include the phenyl ether compounds represented by Formulas I and II described in JP O.P.I. No. 2-66541, page 3, the phenol compounds represented by Formula IIIB described in JP O.P.I. No. 3-174150, the amine compounds represented by Formula A described in JP O.P.I. No. 64-90445 and the metal complexes represented by Formulas XII, XIII, XIV or XV.

The compounds represented by Formula I' described in JP O.P.I. No. 1-196049 and those represented by Formula II described in JP O.P.I. No. 5-11417 are particularly preferred for a yellow dye.

Compounds such as compound (d-11) described in JP O.P.I. No. 4-114154, page 9, lower left column, and compound (A'-1) described on page 10, lower left column, of the same publication are preferably used for shifting the absorption of the formed dye to longer wavelength side. Other than the above, the fluorescent dye releasing compounds described in U.S. Pat. 4,774,187 can be used.

It is preferable in the silver halide photographic light-sensitive material to add a compound capable of reacting with the oxidation product of a developing agent into a layer provided between light-sensitive layers for preventing color contamination or into the silver halide emulsion layer for improving fogging. As such the compound, hydroquinone derivative is preferable and dialkylhydroquinone such as 2,5-di-t-octylhydroquinone is more preferable. The compounds represented by Formula II described in JP O.P.I. No. 4-133056 are particularly preferable which include Compound II-1 through II-14 described on pages 13–14 and Compound 1 described on page 17 of the same publication.

It is preferable to add a UV absorbent in the light-sensitive material of the invention for preventing static fog and improving the light fastness of the dye image. Bezotriazoles are preferable as the UV absorbent. Particularly preferable UV absorbent include the compounds represented by Formula II-3 described in JP O.P.I. No. 1-250944, those represented by Formula III described in JP O.P.I. No. 64-66646, UV-1L through UV-27L described in JP O.P.I. No. 63-187240, the compounds represented by Formula I described in JP O.P.I. No. 4-1633 and those represented by Formula (I) or (II) described in JP O.P.I. No. 5-165144.

Although gelatin is advantageously used as the binder in the silver halide photographic light-sensitive material, a hydrophilic colloid such as a gelatin derivative, a graftpolymer of gelatin and another polymer, a protein other than gelatin, a sugar derivative, a cellulose derivative and a synthesized hydrophilic high molecular weight substance such as a homo- or co-polymer may be used.

A vinylsulfon type hardener and a chlorotriazine type hardener are preferably used singly or in combination to harden such the binders. The compounds described in JP O.P.I. Nos. 61-249054 and 6-245153 are preferable used. Moreover the preservatives and the anti-mold agents described in JP O.P.I. No. 3-157646 are preferably added to prevent breeding of a mold and a bacillus which give bad influences on the photographic property and the storage ability of the image. Furthermore, the lubricants and the matting agents described in JP O.P.I. Nos. 6-118543 and 2-73250 are preferably added to improve the surface property of the light-sensitive material and the processed light-sensitive material.

Any material may be used as the support of the silver halide photographic material of the invention, and paper laminated with polyethylene or poly(ethylene terephthalate), a paper support composed of natural pulp or synthesized pulp, a vinyl chloride sheet, a polypropylene or a poly (ethylene terephthalate) support which may contain a white pigment, and baryta paper can be used. Among them a support composed of raw paper having a waterproof resin overcoat layer on both sides is preferred. Polyethylene, poly(ethylene terephthalate and their copolymer are preferable as the waterproof resin.

An inorganic and/or an organic white pigments may be used as the white pigment in the support, and the inorganic white pigment is preferred. Examples of the inorganic pigment include a sulfate of an alkali-earth metal such as barium sulfate, a carbonate of an alkali-earth metal such as calcium carbonate, silica such as fine-powdered silica and synthesized silicate, calcium silicate, alumina, hydrated alumina, titanium oxide, zinc oxide, talk, and clay. Barium sulfate and titanium oxide are preferable as the white pigment.

The amount of the white pigment contained in the waterproof resin layer provided on the surface of the support is preferably not less than 13%, more preferably 15%, by weight for improving the sharpness of the image.

The dispersion degree of the white pigment in the waterproof resin layer of the paper support to be used in the invention can be measured by the method described in JP O.P.I. No. 2-28640. The dispersion degree of the white pigment measured by this method is preferably not more than 0.20, more preferably not more than 0.15, in terms of the variation coefficient described in the foregoing publication.

It is preferable that the center face average roughness (SRa) of not more than 0.15 $\mu$m, more preferably 0.12 $\mu$m, to obtain a high glossiness.

A slight amount of blue or red tinting agent such as ultramarine and an oil-soluble dye is preferably added into the white pigment-containing waterproof or the coated hydrophilic colloid layer for improving the whiteness of the white background by controlling the balance of spectral reflection density of the white background of the processed light-sensitive material.

The silver halide photographic light-sensitive material of the invention may be directly coated on a surface of the support which has been subjected to a treatment by corona discharge or flame, or may be coated on such the surface through a subbing layer (a one or more subbing layers for raising an adhesiveness, an anti-static property, a dimension stability, a friction resistivity, a hardness an anti-halation property, a friction property and/or another property).

A thickener may be used in the coating liquid for raising the coating suitability at the time of coating the photographic light-sensitive material using the silver halide emulsion. An extrusion coating and a curtain coating are particularly advantageous as the coating method, by which two or more layers can be coated simultaneously.

In the image forming method of the invention, known primary aromatic amine developing agent can be used. Examples of such the compound are described below.

CD-1) N,N-diethyl-p-phenylenediamine
CD-2) 2-amino-5-diethylaminotoluene
CD-3) 1-amino-5-(N-ethyl-N-laurylamino)toluene
CD-4) 4-(N-ethyl-N-(β-hydroxyethyl)amino)aniline
CD-5) 2-methyl-4-(N-ethyl-N-(β-hydroxyethyl)amino) aniline
CD-6) 4-amino-3-methyl-N-ethyl-N(β (methanesulfonamido)ethyl)-aniline
CD-7) N-(2-amino-5-diethylaminophenylethyl) methanesulfonamide
CD-8) N,N-dimethyl-p-phenylenediamine
CD-9) 4-amino-3-methyl-N-ethyl-N-methoxyethylaniline
CD-10) 4-amino-3-methyl-N-ethyl-N-(β-ethoxyethyl) aniline
CD-11) 4-amino-3-methyl-N-ethyl-N-(γ-hydroxypropyl) aniline In the invention, the color developer may be used at an optional pH value. However, a pH value of from 9.5 to 13.0 is preferably used and that of from 9.8 to 12.0 is more preferably used from the viewpoint of rapid processing.

The processing temperature of the color development is preferably from 35° C. to 70° C. A higher temperature is preferable since the processing time can be shortened but it is not suitable for stability of the processing solution. Accordingly, a treatment at a temperature of from 37° C. to 60° C. is preferred.

The color developing is usually performed for a time of about 3 minutes 30 seconds. In the invention, a developing time of from 1 to 40 seconds, particularly from 1 to 25 seconds, is preferable.

Compounds known as ingredients of developing solution may be added to the color developing solution further than the foregoing color developing agent. An alkaline agent having a pH buffer effect, a chloride ion, a development inhibitor such as benzotriazole, a conservative and a chelating agent are commonly used.

The silver halide photographic light-sensitive material is subjected to a bleaching and fixing treatment after the color development. The bleaching treatment may be applied with the fixing treatment at the same time. A washing treatment is usually applied after the fixing treatment.

A stabilizing treatment may be applied in place of the washing treatment.

A roller transporting type processor in which a light-sensitive material is nipped and transported by rollers and an endless belt type processor in which a light-sensitive material is fixed on the belt and transported by the belt, may be used for processing the silver halide photographic light-sensitive material in the invention. A method by which the light-sensitive material is transported in a slit-shaped processing tank together with a processing solution supplied into the slit-shaped processing tank, a spraying method in which a processing solution is sprayed to a light-sensitive material, a web method in which a light-sensitive material is contacted with a web soaked with a processing solution and a method using a viscous processing solution may also be used. When a lot of light-sensitive material is processed, the processing is usually run using an automatic processor. In such the case, a smaller amount of replenisher is preferred. The most preferable embodiment of the processing is that in which the processing composition is replenished in a form of a tablet, and the method described in Koukai Gihou (Journal of Technical Disclosure) No. 94-16935 is most preferable.

An amplifying developing process is a method in which developed silver is formed by developing a latent image with a color or black-and white developer, and a image dye is formed or released by a chemical reaction using the silver as a catalyst. For example, a method is used in which a image dye is formed by coupling reaction with a coupler and the oxidation product of a developing agent formed by a redox reaction of a color developing agent and an oxidizing agent catalyzed by the developed silver.

A compound capable of forming hydrogen peroxide such as hydrogen peroxide, a salt of hydrogen peroxide and an adduct of hydrogen peroxide, a peroxo compound such as a peroxoborate, and a peroxocarbonate, a cobalt(III) complex such as a cobalt ammine complex, a hydrogenite salt such as a chlorite, and a periodate are usable as the oxidizing agent. Among them, a method using a compound capable of forming hydrogen peroxide such as hydrogen peroxide, a salt of hydrogen peroxide and an adduct of hydrogen peroxide is advantageous since the amplifying effect is high and the load to the environment is lowered by this method.

In the amplifying developing process, a combination of an aromatic primary amine developing agent and hydrogen peroxide is preferably used. The foregoing CD-1 through CD-11 are preferably used as the aromatic primary amine developing agent.

Other than the aromatic primary amine developing agent, for example, a sulfonylhydrazide and carbonylhydrazide type developing agent are preferably usable, which are described in European Patent Nos. 565,165, 572,054 and 593,110, and JP O.P.I. Nos. 8-202002, 8-227131 and 8-234390.

In the invention, it is possible to supply the color developing agent and the oxidizing agent for the amplifying development to the light-sensitive material in a form of one processing solution, or in a form of a solution containing the developing agent and a solution containing the oxidizing agent for the amplifying development.

In the image forming method of the invention, for example, a method such as those described in JP O.P.I. Nos. 52-13335, 55-127555 and 61-77851 in which the developing agent and the oxidizing agent are coexisted in the same processing bath, development/amplifying solution, and the formation of developed silver to be the catalyst and the amplifying development continues to the developed silver formation are performed in the same bath, a method such as those described in JP O.P.I. Nos. 5-216192 and 5-346647 in which the developing bath containing the developing agent and the amplifying bath containing the oxidizing agent are separated and the developed silver is formed in the developing bath and the amplifying development is carried out in the amplifying bath by the developing agent carried in the amplifying bath, and a method such as those described in JP O.P.I. Nos. 61-88259 and 7-77788 in which a light-sensitive material is developed in a developing bath containing the developing agent to form developed silver and then amplifying developed in a bath containing the developing agent and the oxidizing agent, may be applicable.

Moreover, a method such as that described in JP O.P.I. No. 61-80150 in which a developing solution, an amplifying solution or a amplifying developing solution is sprayed to a light-sensitive material can be used as a processing method without the use of the processing bath.

When the developing bath and the amplifying bath are separated, the amount of the developing agent in the developing bath is preferably from 0.2 to 10 g/l, particularly preferably from 1 to 5 g/l. The amount of a 30% solution of hydrogen peroxide in the amplifying bath is 0.1 to 100 ml/l.

When the treatment is performed by a monobath composed of a combination the developing bath and the amplifying bath, the amount of the developing agent in the developing/amplifying solution is preferably from 0.5 to 15 g/l, more preferably 1 to 7 g/l, and that of a 30% solution of hydrogen peroxide is preferably from 0.1 to 30 ml/l, more preferably from 1 to 30 ml/l.

Although the developing solution, amplifying solution and the developing/amplifying solution may be used at an optional pH region in the invention, the region of from 9.0 to 12.5 is preferable and that of from 10.5 to 12.0 is more preferable from the viewpoint of the rapidity of processing and the stability of the processing solution.

In the invention, the pH value at the amplifying development is the pH value of the developing/amplifying solution when the processing is carried out by the use of the developing/amplifying solution in which the developing agent and the oxidizing agent for amplifying development are present with together, and is the pH value of the amplifying solution in the amplifying bath when the developing bath and the amplifying bath are separately used. When the developing solution and the amplifying solution are separately applied onto the light-sensitive material, the pH value at the amplifying development is defined by the pH value of a mixture of the developing solution and the amplifying solution in a ratio those to be supplied onto the light-sensitive material. In the invention, the pH value at the amplifying development is preferably from 9.0 to 12.5, more preferably from 10.5 to 12.0, from the viewpoint of rapidity of the processing.

The treatment temperature of the amplifying development is preferably from 20° C. to 60° C. A higher temperature is preferable since a processing time can be shortened. However, a excessively high temperature is not suitable from the viewpoint of the stability of the processing solution. Accordingly, the treatment is preferably performed at a temperature of from 25° C. to 55° C.

The time for the amplifying development is preferably not more than 180 seconds, more preferably not more than 90 seconds, even though the processing time may be varied depending on the kind of light-sensitive material, the temperature of processing and the activity of the processing solution.

Known components for developing solution may be added to the developing solution, the amplifying solution and the developing/amplifying solution together with the foregoing color developing agent and the oxidizing agent. A pH buffering agent, a development inhibitor such as a chloride ion and a benzotriazole, a conservative and a chelating agent.

As the pH buffering agent, known buffering agents can be used. Among them, a buffering agent composed of a carbonate and/or a phosphate is preferably since their cost are low.

It is preferable that the color developing agent and the black-and-white developing agent are used in combination since the processing time can be shortened in addition to the effect of the invention, and the stability of the gradation reproducibility is enhanced when the light-sensitive material has plural layers since the influence of development of another layer on the developing speed of one layer is reduced.

The black-and-white developing agent usable in the invention include hydroxybenzenes, 3-pyrazolidones, pyrogallols, glycines, hydroxylamines, hydrazines, aminophenols, reductones, 3-aminopyrazolines and transition metal complexes (a complex salt of a transition metal such as Ti, Cr, Mn, Fe, Co, Ni, and Cu having a reducing ability, for example, one in a form complex salt of $Ti^{3+}$, $V^{2+}$, $Cr^{2+}$ or $Fe^{2+}$, with a ligand, for example, an aminopolycarboxylic acid and its salt such as ethylenediaminetetraacetic acid (EDTA) and diethylentriaminepentaacetic acid (DTPA) and their salts, and phosphoric acid and its salt such as hexametapolyphosphoric acid and tetrapolyphosphoric acid and their salts. Among them, the hydroxybenzenes, 3-pyrazolidones, hydroxylamines and reductones are preferable. The using amount of the black-and white developing agent is preferably from 0.1 to 3.0, more preferably from 0.25 to 2.0 in the mole ratio to the color developing agent.

The light-sensitive material preferably used for image formation by the amplifying development in the invention preferably has the total amount of light-sensitive silver halide of from 0.001 g/m$^2$ to 0.3 g/m$^2$ in terms of silver. The total mount of light-sensitive silver halide of from 0.001 g/m$^2$ to 0.15 g/m$^2$ is preferred for enhancing the effect of the invention.

EXAMPLES

(Example 1)

A pulp paper having a weight of 180 g/m$^2$ was laminated on both sides by high density polyethylene to prepare a paper support. The surface on which the emulsion layer to be coated was laminated by a molten polyethylene in which 15% by weight of surface-treated anatase type titanium oxide was dispersed to prepare a reflective support. The reflective support was subjected to corona discharge treatment and coated with a gelatin subbing layer. Then the layers each having the following composition were coated on the surface of the support to prepare a silver halide photographic light-sensitive material. The coating liquids were prepared as follows.

First Layer Coating Liquid

To 60 ml of ethyl acetate, 23.4 g of yellow coupler (Y-1), 3.34 g of dye image stabilizing agent (ST-1), 3.34 g of dye image stabilizing agent (ST-2), 3.34 g of dye image stabilizing agent (ST-5), 0.34 g of stain preventing agent (HQ-1), 5.0 g of image stabilizing agent A, 3.33 g of high-boiling organic solvent (DBP) and 1.67 g of high-boiling organic solvent (DNO) were added and dissolved. The solution was dispersed in 220 ml of a 10% aqueous solution of gelatin containing 7 ml of a 20% solution of surfactant (SU-1) by using an ultrasonic homogenizer to prepare a yellow coupler dispersion. The dispersion was mixed with a blue-sensitive silver halide emulsion prepared under the following conditions to prepare a first layer coating liquid.

Coating solutions for second through seventh layers were each prepared in the similar manner so that the coating amounts were as the followings.

Compounds (H-1) and (H-2) were added as hardeners. For adjusting the surface tension, surfactants (SU-2) and (SU-3) were added. Furthermore, compound F-1 was added to each layer so that the total amount is 0.04 g/m$^2$.

| Layer | Composition | Amount (g/m$^2$) |
|---|---|---|
| 7th layer (Protective layer) | | |
| Gelatin | | 1.00 |
| DIDP | | 0.005 |
| Silicon dioxide | | 0.003 |
| 6th layer (UV absorbing layer) | | |
| Gelatin | | 0.40 |
| UV absorbent (UV-1) | | 0.12 |
| UV absorbent (UV-2) | | 0.04 |
| UV absorbent (UV-3) | | 0.16 |

-continued

| Layer | Composition | Amount (g/m$^2$) |
|---|---|---|
| Stain preventing agent (HQ-5) | | 0.04 |
| PVP | | 0.03 |
| Anti-irradiation dye (AI-2) | | 0.01 |
| 5th layer (Red-sensitive layer) | | |
| Gelatin | | 1.30 |
| Red-sensitive silver chlorobromide emulsion | | 0.21 |
| Cyan coupler (C-1) | | 0.25 |
| Cyan coupler (C-2) | | 0.08 |
| Image stabilizing agent (ST-1) | | 0.10 |
| Stain preventing agent (HQ-1) | | 0.004 |
| DOP | | 0.34 |
| 4th layer (UV absorbing layer) | | |
| Gelatin | | 0.94 |
| UV absorbing agent (UV-1) | | 0.28 |
| UV absorbing agent (UV-2) | | 0.09 |
| UV absorbing agent (UV-3) | | 0.38 |
| Stain preventing agent (HQ-3) | | 0.10 |
| Anti-irradiation dye (AI-2) | | 0.02 |
| 3rd layer (Green-sensitive layer) | | |
| Gelatin | | 1.30 |
| Green-sensitive silver chlorobromide emulsion | | 0.14 |
| Magenta coupler (M-1) | | 0.20 |
| Color image stabilizing agent (ST-3) | | 0.20 |
| Color image stabilizing agent (ST-4) | | 0.17 |
| Anti-irradiation dye (AI-1) | | 0.01 |
| DIDP | | 0.13 |
| DBP | | 0.13 |
| 2nd layer (Interlayer) | | |
| Gelatin | | 1.20 |
| Stain preventing agent (HQ-2) | | 0.03 |
| Stain preventing agent (HQ-3) | | 0.03 |
| Stain preventing agent (HQ-4) | | 0.05 |
| Stain preventing agent (HQ-5) | | 0.23 |
| DIDP | | 0.06 |
| Fluorescent whitening agent (W-1) | | 0.10 |
| Anti-irradiation dye (AI-3) | | 0.01 |
| 1st layer (Blue-sensitive layer) | | |
| Gelatin | | 1.20 |
| Blue-sensitive silver chlorobromide emulsion | | 0.26 |
| Yellow coupler (Y-1) | | 0.70 |
| Image stabilizing agent (ST-1) | | 0.10 |
| Image stabilizing agent (ST-2) | | 0.10 |
| Image stabilizing agent (ST-5) | | 0.10 |
| Image stabilizing agent A | | 0.15 |
| Stain preventing agent (HQ-1) | | 0.01 |
| DBP | | 0.10 |
| NDP | | 0.05 |

Support polyethylene laminated (Containing a slight amount of a tinting agent)

In the above, the amounts of silver halide emulsions are each described in terms of silver.

SU-1: Sodium tri-i-propylnaphthalenesulfonate
SU-2: Sodium salt of di-(2-ethylhexyl) sulfosuccinate
SU-3: Sodium salt of di-(2,2,3,3,4,4,5,5-octafluoropentyl)-sulfosuccinate
DBP: Dibutyl phthalate
DNP: Dinonyl phthalate
DOP: Dioctyl phthalate
DIDP: Di-i-decyl phthalate
PVP: Polyvinylpyrrolidone
H-1: Tetrakis(vinylsulfonylmethyl)methane
H-2: Sodium salt of 2,4-dichloro-6-hydroxy-s-triazine
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonyl)-butylhydroquinone Image stabilizing agent A: p-t-octylphenol
Y-1
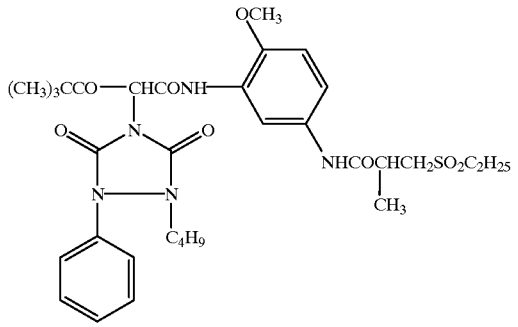
M-1
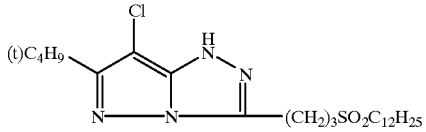
C-1
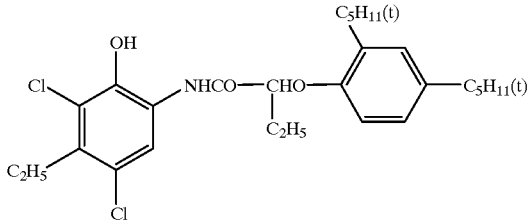
C-2
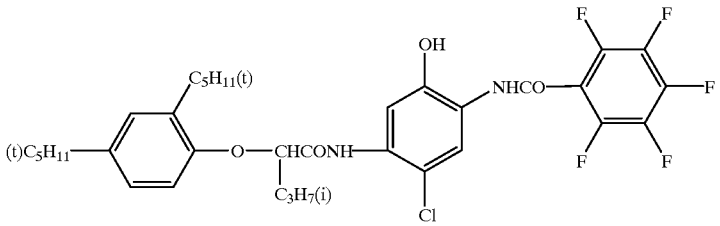
UV-1
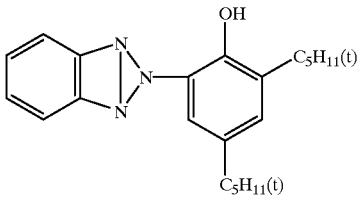
UV-2
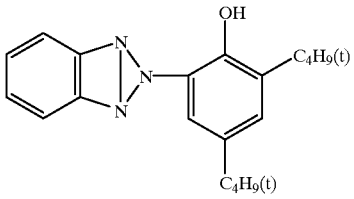

-continued
UV-3
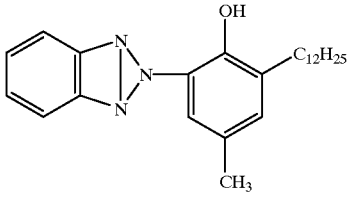
ST-1
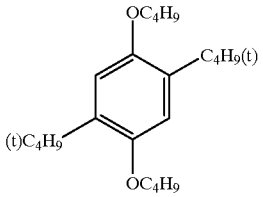
ST-2
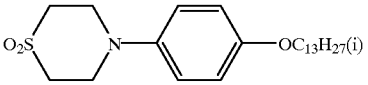
ST-3
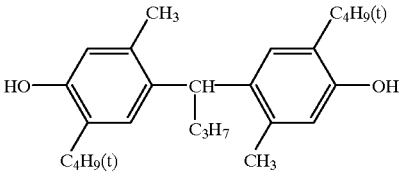
ST-4
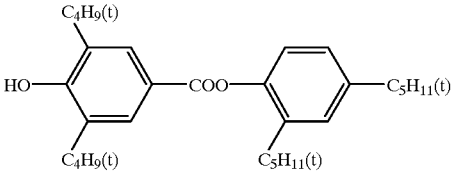
ST-5
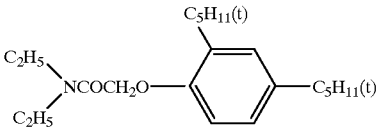
AI-1
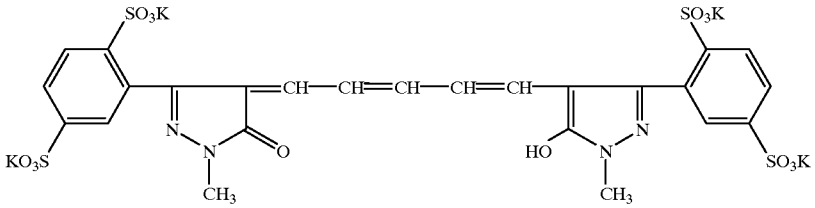
AI-2
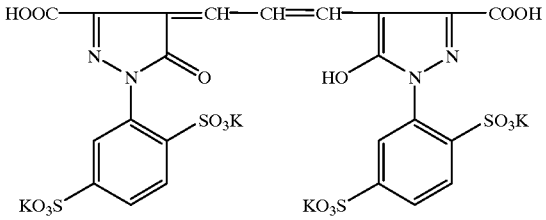

-continued

AI-3

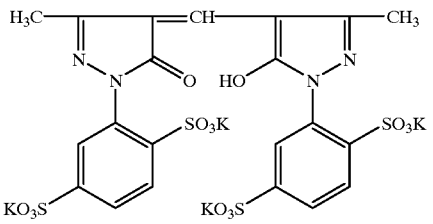

W-1

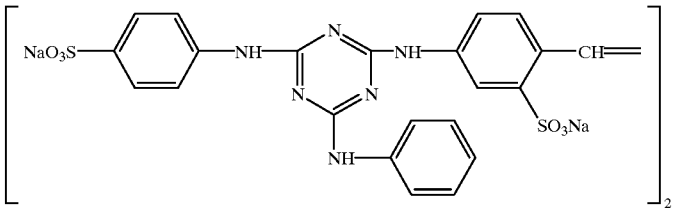

F-1

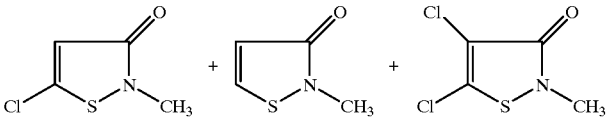

50% 46% 4% in mole ratio

Preparation of Blue-sensitive Silver Halide Emulsion

The following Solution A and Solution B were added by a double-jet method spending 30 minutes to 1 liter of a 2% aqueous gelatin solution maintaining at 40 C while the pAg and pH were held at 7.3 and 3.0, respectively. Then Solution C and Solution D were added spending 180 minutes by a double-jet method while the pH and pAg were held at 8.0 and 5.5, respectively. The control of the pAg was carried out by the method described in JP O.P.I. No. 59-45437, and the control of the pH was carried out by the use of sulfuric acid or sodium hydroxide.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| Sodium chloride | 102.7 g |
| Potassium bromide | 1.0 g |
| Water make to | 600 ml |
| Solution D | |
| Silver nitrate | 300 g |
| Water make to | 600 ml |

After completion of the addition, the emulsion was desalted using a 5% aqueous solution of Demol N, manufactured by Kao-Atlas Co. Ltd., and a 20% aqueous solution of magnesium sulfate. Then the emulsion was mixed with an aqueous gelatin solution. Thus a monodisperse cubic emulsion EMP-0 was prepared, which had an average grain diameter of 0.65 μm, a variation coefficient of grain distribution of 0.07 and a silver chloride content of 99.5 mole-%.

A monodisperse cubic emulsion EMP-1 was prepared in the same manner as in EMP-0 except that Solution E was used in place of Solution C. Solution E is the same as Solution C except that Solution E contained $1\times10^{-8}$ moles of $K_2IrCl_6$ and $1\times10^{-4}$ moles of $K_4Fe(CN)_6$. EMP-1 had an average grain diameter of 0.65 μm, a variation coefficient of grain distribution of 0.07 and a silver chloride content of 99.5 mole-%.

A monodisperse cubic emulsion EMP-1B was prepared in the same manner as in EMP-1 except that Solution F was used in place of Solution E and the time for addition of Solution B and Solution C, and that of Solution D and Solution F were changed. Solution F was the same as Solution C except that Solution F contained $1\times10^{-8}$ moles of $K_2IrCl_6$ and $1\times10^{-5}$ moles of $K_4Fe(CN)_6$. EMP-1 had an average grain diameter of 0.71 μm, a variation coefficient of grain distribution of 0.07 and a silver chloride content of 99.5 mole-%.

EMP-1 was optimally subjected to chemical sensitization at 60° C. using the following compounds to prepare a blue-sensitive silver halide emulsion Em-B101. Besides, EMP-1B was optimally subjected to chemical sensitization in a similar manner to prepare a blue-sensitive silver halide emulsion Em-B102. The blue-sensitive silver halide emulsions Em-B101 and Em-B102 were mixed with together in a ratio of 1:1 in the silver amount. Thus blue-sensitive silver halide emulsion Em-B was obtained.

| | |
|---|---|
| Stabilizing agent STAB-1 | $3\times10^{-4}$ moles/mole of AgX |
| Stabilizing agent STAB-2 | $3\times10^{-4}$ moles/mole of AgX |
| Stabilizing agent STAB-3 | $3\times10^{-4}$ moles/mole of AgX |
| Sensitizing dye BS-1 | $4\times10^{-4}$ moles/mole of AgX |
| Sensitizing dye BS-2 | $1\times10^{-4}$ moles/mole of AgX |

STAB-1:1-(3-acetoamidophenyl)-5-mercaptotetrazole

STAB-2:1-phenyl-5-mercaptotetrazole

STAB-3:1-(4-ethoxyphenyl)-5-mercaptotetrazole

Preparation of Green-sensitive Silver Halide Emulsion

A monodisperse cubic emulsion EMP-2 was obtained in the same manner as in EMP-1 except that the adding time for Solution A and Solution B, and that for Solution C and Solution D were changed. EMP-2 had an average grain diameter of 0.40 μm, a variation coefficient of grain distribution of 0.08 and a silver chloride content of 99.5 mole-%. Besides, a monodisperse cubic emulsion EMP-2B was prepared which had an average grain diameter of 0.50 μm, a variation coefficient of grain distribution of 0.08 and a silver chloride content of 99.5 mole-%.

EMP-2 was optimally subjected to chemical sensitization at 55° C. using the following compounds. Besides, EMP-2B was optimally subjected to chemical sensitization in a similar manner. Thus sensitized EMP-2 and EMP-2B were mixed with together in a ratio of 1:1 in the silver amount. Thus green-sensitive silver halide emulsion Em-G was obtained.

| | | |
|---|---|---|
| Sodium thiosulfate | 1.5 | mg/mole of AgX |
| Chloroauric acid | 1.0 | mg/mole of AgX |
| Stabilizing agent STAB-1 | $3 \times 10^{-4}$ | moles/mole of AgX |
| Stabilizing agent STAB-2 | $3 \times 10^{-4}$ | moles/mole of AgX |
| Stabilizing agent STAB-3 | $3 \times 10^{-4}$ | moles/mole of AgX |
| Sensitizing dye GS-1 | $4 \times 10^{-4}$ | moles/mole of AgX |

Preparation of Red-sensitive Silver Halide Emulsion

A monodisperse cubic emulsion EMP-3 was obtained in the same manner as in EMP-1 except that the adding time for Solution A and Solution B, and that for Solution D and Solution E were changed. EMP-3 had an average grain diameter of 0.40 μm, a variation coefficient of grain distribution of 0.08 and a silver chloride content of 99.5 mole-%. Besides, a monodisperse cubic emulsion EMP-3B was prepared which had an average grain diameter of 0.38 μm, a variation coefficient of grain distribution of 0.08 and a silver chloride content of 99.5 mole-%.

EMP-3 was optimally subjected to chemical sensitization at 60° C. using the following compounds. Besides, EMP-2B was optimally subjected to chemical sensitization in a similar manner. Thus sensitized emulsions EMP-3 and EMP-3B were mixed with together in a ratio of 1:1 in the silver amount. Thus green-sensitive silver halide emulsion Em-R was obtained.

| | | |
|---|---|---|
| Sodium thiosulfate | 1.8 | mg/mole of AgX |
| Chloroauric acid | 2.0 | mg/mole of AgX |
| Stabilizing agent STAB-1 | $3 \times 10^{-4}$ | moles/mole of AgX |
| Stabilizing agent STAB-2 | $3 \times 10^{-4}$ | moles/mole of AgX |
| Stabilizing agent STAB-3 | $3 \times 10^{-4}$ | moles/mole of AgX |
| Sensitizing dye RS-1 | $1 \times 10^{-4}$ | moles/mole of AgX |
| Sensitizing dye RS-2 | $1 \times 10^{-4}$ | moles/mole of AgX |

Compound SS-1 was added to the red-sensitive emulsion in an amount of $2.0'10^{-3}$ moles per mole of silver halide.

BS-1

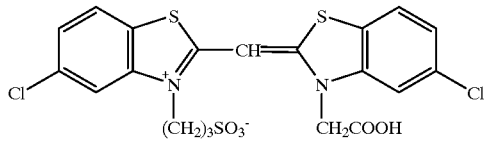

BS-2

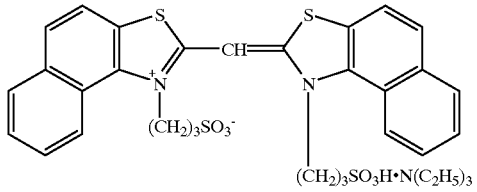

GS-1

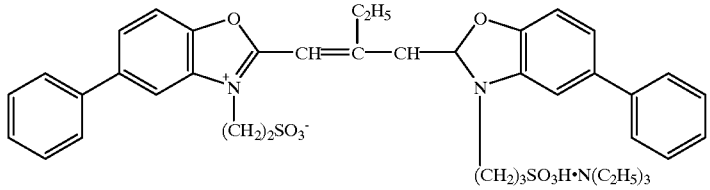

RS-1

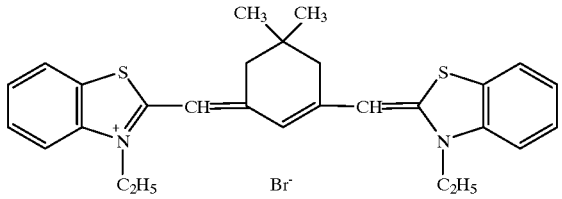

-continued

RS-2

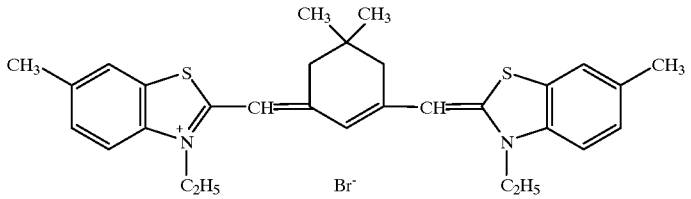

SS-1

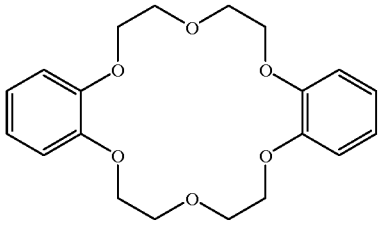

Thus prepared sample was exposed to light by the apparatus described in JP O.P.I. No. 4-264547. Blue-, green and red-light laser beams were used as the light source. The samples was processed by the following Processing A. Processing A was run until the amount of developer replenisher was become to 3 times of the volume of the color developing tank.

Processing A

| Process | Treatment temperature | Time | Replenishing amount |
|---|---|---|---|
| Color developing | 38.0 ± 0.3° C. | 20 seconds | 150 ml |
| Bleach-fixing | 38.0 ± 0.5° C. | 30 seconds | 120 ml |
| Stabilizing | 30 – 34° C. | 60 seconds | 150 ml |
| Drying | 60 – 80° C. | 30 seconds | |

The compositions of the processing solutions are shown below. Tank solution and replenisher of color developer

| | Tank solution | Replenisher |
|---|---|---|
| Purified water | 800 ml | 800 ml |
| Triethylenediamine | 2 g | 3 g |
| Ethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamidoethyl)-3-methyl-4-aminoaniline sulfate | 6.0 g | 10.0 g |
| N,N-diethy1hydroxy1amine | 6.8 g | 6.0 g |
| Triethanolamine | — | 10.0 g |
| Sodium diethylenetriaminepentaacetate | 2.0 g | 2.0 g |
| Fluorescent whitening agent (4,4'-diaminostylbenesulfonic acid derivative | 2.0 g | 2.5 g |
| Potassium carbonate | 30 g | 30 g |
| Water to male | 1 liter | 1 liter |
| Adjust pH to | 10.10 | 10.60 |

Tank solution and replenisher of bleach-fixer

| | |
|---|---|
| Ammonium ferric diethylenetriaminepentaacetate | 65 g |
| Diethylenetriaminepentaacetic acid | 3 g |
| Ammonium thiosulfate (70% aqueous solution) | 100 ml |
| 2-amino-5-mercapto-1,3,4-thiadiazole | 2.0 g |

-continued

| | |
|---|---|
| Ammoniun sulfite (40% aqueous solution) | 27.5 ml |
| Water to make | 1 liter |

Adjust pH to 5.0 using potassium carbonate or glacial acetic acid.

Tank solution and replenisher of Stabilizer

| | |
|---|---|
| o-phenylphenol | 1.0 g |
| 5-chloro-2-methyl-4-isothiazoline-3-one | 0.02 g |
| 2-methyl-4-isothiazoline-3-one | 0.02 g |
| Diethylene glycol | 1.0 g |
| Fluorescent whitening agent (TINOPAL SFP) | 2.0 g |
| 1-hydroxyethylidene-1,1disulfonic acid | 1.8 g |
| Bismuth chloride (45% aqueous solution) | 0.65 g |
| Magnesium sulfate heptahydrate | 0.2 g |
| PVP | 1.0 g |
| Ammonia water (25% aqueous solution of ammonium hydroxide) | 2.5 g |
| Trisodium nitrilotriacetate | 1.5 g |
| Water to make | 1 liter |

Adjust pH to 7.5 using sulfuric acid or ammonia water.

The overlapping width of the rasters was set so as to be not less than 75% of the effective diameter of laser light beam.

The relation of the intensity of laser light beam and the diameter of the laser light beam used for exposure was shown in the following table. The intensity of the laser beam is described in a relative value when the exposure intensity necessary to form a density image of 0.8 is set at 1.

TABLE 1

| Exposure condition | Effective beam diameter $D_{0.8}$ | | Density of obtained image 0.15 | 0.17 | 0.20 | 0.30 | 0.50 | 0.65 | 0.80 | 1.00 | 1.25 | 1.50 | 1.75 | 2.00 | Note |
|---|---|---|---|---|---|---|---|---|---|---|---|---|---|---|---|
| 1 | 80 μm | Beam diameter (μm) | 80 | 80 | 80 | 80 | 80 | 80 | 80 | 80 | 80 | 80 | 80 | 80 | Comp. |
| | | Light beam intensity | 0 | 0.23 | 0.33 | 0.49 | 0.72 | 0.86 | 1 | 1.22 | 1.55 | 1.96 | 2.68 | 4.19 | |
| | | Difference of light beam intensity | 0 | 0 | 0 | 0 | 0 | 0 | 0 | 0 | 0 | 0 | 0 | 0 | |
| | | (Light intensity) × (diameter)$^2$ | 0 | 1472 | 2112 | 3136 | 4608 | 5504 | 6400 | 7808 | 9920 | 12544 | 17152 | 26816 | |
| 2 | 110 μm | Beam diameter (μm) | 110 | 110 | 110 | 110 | 110 | 110 | 110 | 110 | 110 | 110 | 110 | 110 | Comp. |
| | | Light beam intensity | 0 | 0.23 | 0.33 | 0.49 | 0.72 | 0.86 | 1 | 1.22 | 1.55 | 1.96 | 2.68 | 4.19 | |
| | | Difference of light beam intensity | 0 | 0 | 0 | 0 | 0 | 0 | 0 | 0 | 0 | 0 | 0 | 0 | |
| | | (Light intensity) × (diameter)$^2$ | 0 | 2783 | 3993 | 5929 | 8712 | 10406 | 12100 | 14762 | 18755 | 23716 | 32428 | 50699 | |
| 3 | 80 μm | Beam diameter (μm) | 80 | 80 | 80 | 80 | 80 | 80 | 80 | 81.3 | 83.6 | 83.9 | 84.2 | 84.5 | Comp. |
| | | Lightbeam intensity | 0 | 0.23 | 0.33 | 0.49 | 0.72 | 0.86 | 1 | 1.18 | 1.42 | 1.78 | 2.42 | 3.76 | |
| | | Difference of light beam intensity | 0 | 0 | 0 | 0 | 0 | 0 | 0 | −0.04 | −0.13 | −0.18 | −0.26 | −0.43 | |
| | | (Light intensity) × (diameter)$^2$ | 0 | 1472 | 2112 | 3136 | 4608 | 5504 | 6400 | 7799 | 9924 | 12530 | 17157 | 26847 | |
| 4 | 80 μm | Beam diameter (μm) | 80 | 80 | 80 | 80 | 80 | 80 | 80 | 78.7 | 76.6 | 78.6 | 80.0 | 82.1 | Comp. |
| | | Lightbeam intensity | 0 | 0.23 | 0.33 | 0.49 | 0.72 | 0.86 | 1 | 1.26 | 1.69 | 2.03 | 2.68 | 3.98 | |
| | | Difference of light beam intensity | 0 | 0 | 0 | 0 | 0 | 0 | 0 | 0.04 | 0.14 | 0.07 | 0 | −0.21 | |
| | | (Light intensity) × (diameter)$^2$ | 0 | 1472 | 2112 | 3136 | 4608 | 5504 | 6400 | 7804 | 9916 | 12541 | 17152 | 26827 | |
| 5 | 80 μm | Beam diameter (μm) | 80 | 80 | 80 | 80 | 80 | 80 | 80 | 78.7 | 76.6 | 75.0 | 73.1 | 72.3 | Inventive |
| | | Light beam intensity | 0 | 0.23 | 0.33 | 0.49 | 0.72 | 0.86 | 1 | 1.26 | 1.69 | 2.23 | 3.21 | 5.12 | |
| | | Difference of light beam intensity | 0 | 0 | 0 | 0 | 0 | 0 | 0 | 0.04 | 0.14 | 0.27 | 0.53 | 0.93 | |
| | | (Light intensity) × (diameter)$^2$ | 0 | 1472 | 2112 | 3136 | 4608 | 5504 | 6400 | 7804 | 9916 | 12544 | 17153 | 26764 | |
| 6 | 80 μm | Beam diameter (μm) | 80 | 80 | 80 | 80 | 80 | 80 | 80 | 77.5 | 75.1 | 73.5 | 69.8 | 69.0 | Inventive |
| | | Light beam intensity | 0 | 0.23 | 0.33 | 0.49 | 0.72 | 0.86 | 1 | 1.30 | 1.76 | 2.32 | 3.52 | 5.63 | |
| | | Difference of light beam intensity | 0 | 0 | 0 | 0 | 0 | 0 | 0 | 0.08 | 0.21 | 0.36 | 0.84 | 1.44 | |
| | | (Light intensity) × (diameter)$^2$ | 0 | 1472 | 2112 | 3136 | 4608 | 5504 | 6400 | 7808 | 9926 | 12533 | 17150 | 26804 | |

TABLE 1-continued

| Exposure condition | Effective beam diameter $D_{0.8}$ | | Density of obtained image 0.15 | 0.17 | 0.20 | 0.30 | 0.50 | 0.65 | 0.80 | 1.00 | 1.25 | 1.50 | 1.75 | 2.00 | Note |
|---|---|---|---|---|---|---|---|---|---|---|---|---|---|---|---|
| 7 | 110 μm | Beam diameter (μm) | 110 | 110 | 110 | 110 | 110 | 110 | 110 | 107.4 | 104.1 | 101.3 | 98.1 | 97.3 | Inventive |
| | | Light beam intensity | 0 | 0.23 | 0.33 | 0.49 | 0.72 | 0.86 | 1 | 1.28 | 1.73 | 2.31 | 3.37 | 5.35 | |
| | | Difference of light beam intensity | 0 | 0 | 0 | 0 | 0 | 0 | 0 | 0.06 | 0.18 | 0.35 | 0.69 | 1.16 | |
| | | (Light intensity) × (diameter)$^2$ | 0 | 2783 | 3993 | 5929 | 8712 | 10406 | 12100 | 14764 | 18748 | 23705 | 32432 | 50650 | |

The difference of light beam intensity corresponds to (Laser light beam intensity A(D) − (Laser light beam intensity C(D))

In Table 1, the difference of light beam intensity is corresponts to (Laser light beam intensity $I_{d1}$)−(Laser light beam intensity $I_{0.8}$), in which $I_{0.8}$ is the intensity for forming sn image having a density of 0.8.

In Exposure Condition 1 and Exposure Condition 3 shown in Table 1, the beam diameter was constant with no relation to the image density. and the relation between laser beam intensity $I'_{d1}$ and the laser beam diameter $D_{0.8}$ was satisfied. In Exposure Condition 3 and Exposure Condition 4, the values β are substantially the same as that represented by (light intensity)×(diameter)$^2$ of Exposure Condition 1 and Equation (I) was satisfied. However, the relation of Relation (1) was not satisfied in the region of not less than 0.8.

Moreover, in Exposure Condition 3, the relation of Relation (2) was not satisfied since the diameter of the laser light beam was larger than that in Exposure Condition 1 at an image density of 1.25.

In Exposure Condition 4, the relation of Relation (2) was not satisfied since the diameter of the laser light beam was larger than that in Exposure Condition 1 in the region of image density of not less than 1.75.

In Exposure Conditions 5 and 6, the Relation (2) was satisfied since the value of β calculated by (light intensity) ×(diameter)$^2$ was substantially the same, in the region image density of from 0.8 to 3.0, as the α value calculated by (light intensity)×(diameter)$^2$ of Exposure Condition 1.

In Exposure Conditions 5, and 6, Relation (2) was satisfied since the laser beam diameter in Exposure Conditions 5 and 6 are smaller than the laser beam diameter for forming the same image density in Exposure Condition 1 in the region of image density of from 0.8 to 3.0.

Furthermore, the difference between the intensity of laser light beam in Exposure Condition 5 and 6, and that of in Exposure Condition 1 necessary to form the same image density (difference of light beam intensity in Table 1 was made larger accompanied with increasing of the image density. Accordingly, it was understood that Relation (3) was satisfied.

Exposure Condition 7 satisfies Relations (1), (2) and (3) with respect to Exposure Condition 2.

Printed image of a landscape scene and a portrait were visually evaluated by 10 observer to classify into 5 ranks. And an average points of the classified results by the 10 observer. Point of 5 was given to an preferable image having a high sharpness. Thus obtained results are shown in the following Table 2.

TABLE 2

| Sample | Relation between light beam intensity to beam diamter | Laser exposure: Landscape Sharpness | Landscape In all | Portrait Sharpness | Portrait In all | Average Sharpness | Average In all | Note |
|---|---|---|---|---|---|---|---|---|
| 101 | Exposure condition 1 | 2.3 | 2.4 | 1.2 | 2.0 | 1.8 | 2.2 | Comparative |
| 102 | Exposure condition 2 | 2.1 | 2.3 | 1.1 | 1.8 | 1.6 | 2.1 | Comparative |
| 103 | Exposure condition 3 | 2.4 | 2.5 | 1.1 | 1.8 | 1.8 | 2.2 | Comparative |
| 104 | Exposure condition 4 | 2.2 | 2.5 | 1.3 | 2.9 | 1.8 | 2.7 | Comparative |
| 105 | Exposure condition 5 | 4.0 | 4.2 | 3.9 | 4.5 | 4.0 | 4.4 | Inventive |
| 106 | Exposure condition 6 | 3.8 | 4.2 | 4.2 | 4.4 | 4.0 | 4.3 | Inventive |
| 107 | Exposure condition 7 | 4.1 | 4.0 | 4.1 | 4.3 | 4.1 | 4.2 | Inventive |

As shown in Table 2, the sharpness at a high density portion such as the portion of hair of the portrait was clearly perceived in the samples exposed by Patters 5, 6 and 7 of the relation of the laser light beam intensity to the laser light beam diameter, and such the samples each form a suitably modulated image. It is understood that the effects of the invention are obtained.

Moreover, the samples having a fundamental γ within the range of the invention are obtain a high evaluation points of the image when the image is formed either by the exposure by laser light beam or the exposure through a negative film. Thus it is understood that such the embodiment is preferable.

Example 2

Samples 201 through 204 were prepared in the same manner as in Sample 101 except that the compositions of the first, third and fifth layers were optionally varied so as to vary the fundamental γ of the yellow image, magenta image and cyan image according to the method described in the constitution of the invention.

Prints of the landscape scene and the portrait the same as those in Example 1 were obtained using Samples 201 through 204. The relation of laser light beam intensity and the laser light beam diameter of Exposure Condition 5 in Example 1 was applied to the exposure. Besides, the same scenes photographed by Konica Color JX-400 Film were printed using an automatic processor NPS-868J with processing chemicals ECOJET-P, manufactured by Konica Corp. Thus obtained prints were visually evaluated to classify into 5 ranks.

Thus obtained results and the fundamental γ of each of the sample are shown in the following table.

TABLE 3

| Sample | Relation between light beam intensity to beam diamter | Laser exposure | | | | | | Negative film | | Fundamental γ | | |
|---|---|---|---|---|---|---|---|---|---|---|---|---|
| | | Landscape | | Portrait | | Average | | Average | | | | |
| | | Sharpness | In all | Sharpness | In all | Sharpness | In all | Sharpness | In all | Y | M | C |
| 201 | Exposure condition 5 | 4.0 | 4.2 | 3.9 | 4.5 | 4.0 | 4.4 | 4.2 | 4.3 | 2.76 | 2.85 | 2.94 |
| 202 | Exposure condition 5 | 4.3 | 4.0 | 4.6 | 3.2 | 4.5 | 3.6 | 3.7 | 1.8 | 4.21 | 4.56 | 5.21 |
| 203 | Exposure condition 5 | 4.2 | 4.1 | 4.3 | 4.5 | 4.3 | 4.3 | 4.1 | 4.1 | 2.12 | 2.23 | 2.41 |
| 204 | Exposure condition 5 | 3.8 | 3.9 | 3.9 | 4.0 | 3.9 | 4.0 | 2.4 | 1.8 | 0.73 | 0.82 | 0.86 |

As is shown in Table 3, the image suitably modulated image can be obtained by the scanning exposure by the laser light beam according to the relation of the laser light beam intensity to the laser light beam diameter of Exposure Condition 5.

It is understood that the samples having the fundamental γ within the range of from 1.0 to 3.5 have a high compatibility between the exposure by the laser light beam and that through a negative film since the images formed by such the samples are each given a high evaluation point when the exposure is given through the negative film. It is established that such the samples are more preferable embodiment of the invention.

Example 3

In the laser exposing apparatus used in Example 1, the temperature of the sample at the moment of exposure was controlled by heating the drum on which the samples was fixed. Images were formed on Sample 101 of Example 1 using this apparatus. The relation of laser light beam intensity and the laser light beam diameter of Exposure Condition 5 in Example 1 was applied to the exposure. On/off of the temperature control, change of the controlled temperature and change of the temperature at the place where the apparatus was installed where tested at the moment of the exposure. The image was an uniform image by laser output so as to form an image density of 0.75 under the evaluation condition 4 shown in Table 4 in which the temperature at the place at which the apparatus was installed: 25° C. and the temperature of the sample at the moment of the exposure was 90° C. The evaluation conditions are shown in Table 4, in which the temperature at the place at which the apparatus was installed and the temperature of sample are changed.

TABLE 4

| Evaluation condition | Temperature of atmosphere | Temperature controll of sample Controll | Temperature of sample (° C.) |
|---|---|---|---|
| 1 | 25 | Off | 30 ± 5 |
| 2 | 10 | Off | 15 ± 9 |
| 3 | 45 | Off | 50 ± 8 |
| 4 | 25 | On | 90 ± 2 |
| 5 | 10 | On | 90 ± 2 |
| 6 | 45 | On | 90 ± 2 |
| 7 | 25 | On | 50 ± 2 |
| 8 | 10 | On | 50 ± 2 |
| 9 | 45 | On | 50 ± 2 |
| 10 | 25 | On | 90 ± 8 |

TABLE 4-continued

| Evaluation condition | Temperature of atmosphere | Temperature controll of sample Controll | Temperature of sample (° C.) |
|---|---|---|---|
| 11 | 10 | On | 90 ± 8 |
| 12 | 45 | On | 90 ± 8 |
| 13 | 25 | On | 10 ± 2 |
| 14 | 10 | On | 10 ± 2 |
| 15 | 45 | On | 10 ± 2 |
| 16 | 25 | On | 120 ± 2 |
| 17 | 10 | On | 120 ± 2 |
| 18 | 45 | On | 120 ± 2 |

One hundred sheets of image were continuously prepared under each of the conditions. respectively. The density of image was measured by a densitometer PDA-65, manufactured by Konica Corp. The average image density of the 100 image, the standard deviation of density of the 100 image, the difference between the density formed at 25° C. and the density formed at 10° C. or 40° C., and the reciprocity of each of density added with a minus sign are listed in Table 5.

TABLE 5

| Evaluation | Average density of image | | | Standard deviation of image density | | | Difference of image density from the image formed at 25° C. | | | Reciprocal of density with negative sign | | |
|---|---|---|---|---|---|---|---|---|---|---|---|---|
| condition | Blue | Green | Red | Blue | Green | Red | Blue | Green | Red | Blue | Green | Red |
| 1 | 0.60 | 0.51 | 0.49 | 0.031 | 0.028 | 0.029 | 0 | 0 | 0 | −1.67 | −1.96 | −2.04 |
| 2 | 0.53 | 0.44 | 0.42 | 0.068 | 0.066 | 0.070 | −0.07 | −0.07 | −0.07 | −1.89 | −2.27 | −2.38 |
| 3 | 0.68 | 0.63 | 0.64 | 0.072 | 0.069 | 0.071 | 0.08 | 0.12 | 0.15 | −1.47 | −1.59 | −1.56 |
| 4 | 0.75 | 0.75 | 0.75 | 0.012 | 0.011 | 0.011 | 0.00 | 0.00 | 0.00 | −1.33 | −1.33 | −1.33 |
| 5 | 0.73 | 0.74 | 0.73 | 0.011 | 0.011 | 0.011 | −0.02 | −0.01 | −0.02 | −1.37 | −1.35 | −1.37 |
| 6 | 0.75 | 0.76 | 0.74 | 0.012 | 0.010 | 0.011 | 0.00 | 0.01 | −0.01 | −1.33 | −1.32 | −1.35 |
| 7 | 0.65 | 0.67 | 0.66 | 0.011 | 0.010 | 0.011 | 0.00 | 0.00 | 0.00 | −1.54 | −1.49 | −1.52 |
| 8 | 0.63 | 0.66 | 0.65 | 0.011 | 0.011 | 0.012 | −0.02 | −0.01 | −0.01 | −1.59 | −1.52 | −1.54 |
| 9 | 0.65 | 0.66 | 0.65 | 0.010 | 0.010 | 0.011 | 0.00 | −0.01 | −0.01 | −1.54 | −1.52 | −1.54 |
| 10 | 0.75 | 0.75 | 0.75 | 0.072 | 0.070 | 0.071 | 0.00 | 0.00 | 0.00 | −1.33 | −1.33 | −1.33 |
| 11 | 0.73 | 0.73 | 0.73 | 0.068 | 0.066 | 0.070 | −0.02 | −0.02 | −0.02 | −1.37 | −1.37 | −1.37 |
| 12 | 0.75 | 0.75 | 0.74 | 0.072 | 0.074 | 0.073 | 0.00 | 0.00 | −0.01 | −1.33 | −1.33 | −1.35 |
| 13 | 0.38 | 0.35 | 0.33 | 0.010 | 0.011 | 0.011 | 0.00 | 0.00 | 0.00 | −2.63 | −2.86 | −3.03 |
| 14 | 0.36 | 0.33 | 0.33 | 0.010 | 0.011 | 0.012 | −0.02 | −0.02 | 0.00 | −2.78 | −3.03 | −3.03 |
| 15 | 0.36 | 0.35 | 0.34 | 0.012 | 0.010 | 0.011 | −0.02 | 0.00 | 0.01 | −2.78 | −2.86 | −2.94 |
| 16 | 0.82 | 0.84 | 0.84 | 0.011 | 0.010 | 0.011 | 0.00 | 0.00 | 0.00 | −1.22 | −1.19 | −1.19 |
| 17 | 0.84 | 0.85 | 0.84 | 0.011 | 0.011 | 0.010 | 0.02 | 0.01 | 0.00 | −1.19 | −1.18 | −1.19 |
| 18 | 0.83 | 0.83 | 0.85 | 0.011 | 0.010 | 0.011 | 0.01 | −0.01 | 0.01 | −1.20 | −1.20 | −1.18 |

It is understood form the results listed in Table 5 that the image can be stably obtained with a little fluctuation on image density when the temperature at the moment of exposure set at a specified value within the range of from 30° C. to 100° C. and the temperature is maintained within the range of ±3° C. of the specified temperature according to the invention.

Example 4

Emulsions were prepared in the same manner as in EMP-1 and EMP-1B except that the metal compounds shown in Table 6 were added in place of $K_2IrCl_6$ and $K_4Fe(CN)_6$ in Solution E. The emulsions were chemically sensitized in the same manner as in EMP-1 and EMP-1B. The sensitivity of each of the emulsion was determined in the manner described in Example 1 of JP O.P.I. No. 8-274645. The grain diameter, the content of electron trapping metal compound and the content of hole trapping metal compound of thus obtained emulsions are shown in Table 6.

TABLE 6

| Emulsion No. | Grain diameter (μm) | Metal compound 1 | | | | Metal compound 2 | | | |
|---|---|---|---|---|---|---|---|---|---|
| | | Kind | | Attenuation time ratio | Amount | Kind | | Attenuation time ratio | Amount |
| B101 | 0.65 | $K_2IrCl_6$ | Electron trapping | 0.5 | $5.7 \times 10^{-9}$ | $K_4Fe(CN)_6$ | Hole trapping | 5.8 | $5.7 \times 10^{-5}$ |
| B102 | 0.71 | $K_2IrCl_6$ | Electron trapping | 0.5 | $5.7 \times 10^{-9}$ | $K_4Fe(CN)_6$ | Hole trapping | 5.8 | $5.7 \times 10^{-6}$ |
| B301 | 0.65 | — | — | — | — | — | — | — | — |
| B302 | 0.65 | $K_2IrCl_6$ | Electron trapping | 0.5 | $5.7 \times 10^{-9}$ | $K_4Fe(CN)_6$ | Hole trapping | 5.8 | $2.8 \times 10^{-5}$ |
| B303 | 0.65 | $K_2IrCl_6$ | Electron trapping | 0.5 | $2.8 \times 10^{-8}$ | $K_4Fe(CN)_6$ | Hole trapping | 5.8 | $2.8 \times 10^{-5}$ |
| B304 | 0.65 | $Cs_2Os(NO)Cl_5$ | Electron trapping | 0.3 | $5.7 \times 10^{-8}$ | $K_4Ru(CN)_6$ | Hole trapping | 2.2 | $2.8 \times 10^{-5}$ |
| B305 | 0.65 | $Cs_2Os(NO)Cl_5$ | Electron trapping | 0.3 | $5.7 \times 10^{-9}$ | $K_4Ru(CN)_6$ | Hole trapping | 2.2 | $2.8 \times 10^{-6}$ |
| B306 | 0.71 | — | — | — | — | — | — | — | — |
| B307 | 0.71 | $K_2IrCl_6$ | Electron trapping | 0.5 | $2.8 \times 10^{-9}$ | $K_4Fe(CN)_6$ | Hole trapping | 5.8 | $2.8 \times 10^{-4}$ |
| B308 | 0.71 | $K_2IrCl_6$ | Electron trapping | 0.5 | $5.7 \times 10^{-9}$ | $K_4Fe(CN)_6$ | Hole trapping | 5.8 | $2.8 \times 10^{-5}$ |
| B309 | 0.71 | $K_2IrCl_6$ | Electron trapping | 0.5 | $1.1 \times 10^{-6}$ | $K_4Fe(CN)_6$ | Hole trapping | 5.8 | $5.7 \times 10^{-6}$ |
| B310 | 0.71 | $Cs_2Os(NO)Cl_5$ | Electron trapping | 0.3 | $5.7 \times 10^{-9}$ | $K_4Ru(CN)_6$ | Hole trapping | 2.2 | $2.8 \times 10^{-6}$ |

TABLE 6-continued

| Emulsion No. | Grain diameter (μm) | Metal compound 1 Kind | | Attenuation time ratio | Amount | Metal compound 2 Kind | | Attenuation time ratio | Amount |
|---|---|---|---|---|---|---|---|---|---|
| B311 | 0.71 | $Cs_2Os(NO)Cl_5$ | Electron trapping | 0.3 | $5.7 \times 10^{-9}$ | $K_4Ru(CN)_6$ | Hole trapping | 2.2 | $5.7 \times 10^{-7}$ |

Samples 301 through 312 were prepared in the same manner as in Sample 101 of Example 1 except that the mixture of the emulsions in a ratio of 1:1 was used in place of the blue-sensitive emulsion.

TABLE 7

| Sample | High speed emulsion | Low speed emulsion | Parameter |
|---|---|---|---|
| 1 | Em-B306 | Em-B301 | — |
| 2 | Em-B306 | Em-B101 | — |
| 3 | Em-B102 | Em-B301 | — |
| 4 | Em-B102 | Em-B305 | 0.65 |
| 5 | Em-B307 | Em-B101 | 0.52 |
| 6 | Em-B308 | Em-B101 | 2.61 |
| 7 | Em-B309 | Em-B101 | 6.52 |
| 8 | Em-B102 | Em-B302 | 6.52 |
| 9 | Em-B309 | Em-B303 | 16.29 |
| 10 | Em-B310 | Em-B302 | 13.63 |
| 11 | Em-B309 | Em-B304 | 32.58 |
| 12 | Em-B311 | Em-B302 | 65.16 |

An uniform image is formed on each of Samples 301 through 312 in the same manner as in Example 3. In the test, the interval between the exposure and development was changed. On the other hand, an uniform image was obtained by controlling the scanning speed and the output power of the laser light so that the exposure amount is become an amount the same as that in Example 3 when the exposure time of 1 second. The difference of blue density between the image formed with the interval of the exposure and the development of 30 seconds and the image formed with the interval of the exposure and the development of 30 minutes, and the change of the blue density when the exposure time was 1 second were described in followings.

TABLE 8

| Sample | Parameter | Blue density: Change of interval from exposure to development | Blue density: Different between the sample exposed for 1 second |
|---|---|---|---|
| 301 | — | −0.18 | 0.01 |
| 302 | — | −0.20 | −0.01 |
| 303 | — | −0.12 | 0.04 |
| 304 | 0.65 | −0.32 | 0.09 |
| 305 | 0.52 | −0.11 | 0.18 |
| 306 | 2.61 | −0.04 | 0.03 |
| 307 | 6.52 | −0.03 | 0.02 |
| 308 | 6.52 | −0.05 | 0.01 |
| 309 | 16.29 | −0.02 | 0.02 |
| 310 | 13.63 | −0.05 | 0.00 |
| 311 | 32.58 | −0.06 | 0.19 |
| 312 | 65.16 | −0.04 | 0.21 |

As is shown in Table 8, it is understood that in the silver halide photographic light-sensitive material using the mixture of the emulsions satisfying Equation (IV) of the invention is small in the density variation caused by the change of the interval from the exposure to the development and the change of exposure time, and stable image is obtained.

Example 5

Sample 401 was prepared in the same manner as in Sample 101 except that the coating amounts of the first, third and fifth layers were reduced so the coating amount of each layer were become as follows.

| | |
|---|---|
| Red-sensitive silver halide emulsion | 0.018 $g/m^2$ |
| Green-sensitive silver halide emulsion | 0.020 $g/m^2$ |
| Blue-sensitive silver halide emulsion | 0.060 $g/m^2$ |

The amount of silver halide is described in terms of silver.

Images were formed on Sample 401 and Sample 307 of Example 4 according to Example 1 using the apparatus of Example 3. The samples were subjected to an amplifying developing process by the following Process AP-1.

Process AP-1

| Processing | Processing temperature | Time |
|---|---|---|
| Amplifying developing solution (CDA-1) | 35.0 ± 0.5° C. | 40 seconds |
| Bleach-fixing solution | 30.0 ± 0.5° C. | 45 seconds |
| Stabilizing solution | 30 – 34° C. | 60 seconds |
| Drying | 60 – 80° C. | 30 seconds |

The compositions of the processing solutions were as follows. Amplifying developing solution (CDA-1)

| | |
|---|---|
| Purified water | 800 ml |
| Potassium bromide | 0.001 g |
| Potassium chloride | 0.35 g |
| N-ethyl-N-(β-methanesulfonamidoethyl)-3-methyl-4-aminoaniline sulfate | 4.0 g |
| N,N-diethylhydroxylamine | 4.7 g |
| Hydroxylamine sulfate | 1.0 g |
| Pentasodium diethylenetriaminepentaacetate | 2.0 g |
| 1-hydroxyethylidene-1,1'-disulfonic acid | 0.35 g |
| Fluorescent whitening agent (4,4'-diamino-stilbenedisulfonic acid derivative | 2.0 g |
| Disodium phosphate | 10 g |
| Potassium carbonate | 20 g |
| Hydrogen peroxide (5.99%) | 25 ml |

Adjust pH to 11.0 using potassium hydroxide or sulfuric acid and makeup to 1 liter by water.

The bleach-fixing solution was the same as that in Example 1.

| Stabilizing solution | |
|---|---|
| Purified water | 800 ml |
| o-phenylphenol | 1.0 g |
| 5-chloro-2-methyl-4-isothiazoline-3-one | 0.02 g |
| 2-methyl-4-isothiazoline-3-one | 0.02 g |
| Diethylene glycol | 1.0 g |
| Fluorescent whitening agent (Tinopal SFP) | 2.0 g |
| 1-hydroxyethylidene-1,1'-disulfonic acid | 1.8 g |
| Bismuth chloride (45% aqueous solution) | 0.65 g |
| magnesium sulfate heptahydrate | 0.2 g |
| PVP (Polyvinylpyrrolidone) | 1.0 g |
| Ammonia water (25% aqueous solution of ammonium hydroxide) | 2.5 g |
| Trisodium nitrilotriacetate | 1.5 g |

Makeup to 1 liter by water, and adjust pH to 7.5 buy sulfuric acid or ammonia water.

Thus obtained images were evaluated in the same manner as in Example 1, and the fundamental γ of the image were determined. Results are shown in Table 9.

TABLE 9

| Sample | Relation between intensity and diameter of laser light beam | Laser exposure: Landscape Sharpness | Landscape In all | Portrait Sharpness | Portrait In all | Average Sharpness | Average In all | Negative film: Average Sharpness | Average In all | Fundamental γ: Y | M | C | Note |
|---|---|---|---|---|---|---|---|---|---|---|---|---|---|
| 101 | Exposure condition 1 | 3.9 | 3.1 | 3.8 | 3.4 | 3.9 | 3.3 | 4.1 | 2.1 | 4.21 | 4.51 | 4.36 | Comp. |
| 307 | Exposure condition 1 | 2.0 | 2.4 | 1.9 | 2.1 | 2.0 | 2.3 | 4.2 | 4.3 | 2.85 | 2.97 | 3.01 | Comp. |
| 307 | Exposure condition 2 | 1.8 | 2.3 | 2.0 | 2.2 | 1.9 | 2.3 | 4.2 | 4.3 | 2.85 | 2.97 | 3.01 | Comp. |
| 307 | Exposure condition 5 | 3.9 | 3.9 | 4.1 | 4.3 | 4.0 | 4.1 | 4.2 | 4.3 | 2.85 | 2.97 | 3.01 | Inv. |
| 307 | Exposure condition 7 | 4.1 | 4.1 | 4.2 | 4.0 | 4.2 | 4.1 | 4.2 | 4.3 | 2.85 | 2.97 | 3.01 | Inv. |
| 401 | Exposure condition 1 | 2.1 | 2.1 | 1.1 | 1.7 | 1.6 | 1.9 | 3.8 | 4.1 | 2.67 | 2.73 | 2.84 | Comp. |
| 401 | Exposure condition 2 | 1.8 | 2.0 | 0.9 | 1.8 | 1.4 | 1.9 | 3.8 | 4.1 | 2.67 | 2.73 | 2.84 | Comp. |
| 401 | Exposure condition 3 | 2.1 | 1.8 | 0.8 | 2.0 | 1.5 | 1.9 | 3.8 | 4.1 | 2.67 | 2.73 | 2.84 | Comp. |
| 401 | Exposure condition 4 | 2.0 | 2.2 | 0.9 | 1.8 | 1.5 | 2.0 | 3.8 | 4.1 | 2.67 | 2.73 | 2.84 | Comp. |
| 401 | Exposure condition 5 | 3.8 | 4.1 | 3.9 | 4.3 | 3.9 | 4.2 | 3.8 | 4.1 | 2.67 | 2.73 | 2.84 | Inv. |
| 401 | Epposure condition 6 | 4.0 | 4.0 | 3.8 | 4.2 | 3.9 | 4.1 | 3.8 | 4.1 | 2.67 | 2.73 | 2.84 | Inv. |
| 401 | Exposure condition 7 | 3.9 | 3.9 | 4.1 | 4.4 | 4.0 | 4.2 | 3.8 | 4.1 | 2.67 | 2.73 | 2.84 | Inv. |

As is shown in Table 9, in the case that the silver halide photographic material having a small coating amount of silver is processed by the amplifying development, the effects of the invention can be obtained by the relation of the laser light beam intensity to the laser light beam diameter according to the invention. The effects that a suitably modulated image having a high sharpness and contrast can be obtained, is enhanced in the sample having a small coating amount of silver.

The samples having the fundamental γ value within the range of the invention is given a high evaluation rank of image in either case of image formation by laser beam or by the exposure through the negative film. It is understood that such the samples are the preferable embodiment of the invention.

What is claimed is:

1. A method for forming an image comprising the steps of exposing a photographic image forming medium by scanning by a light beam, and developing the photographic image forming medium to form an image, wherein the diameter and the intensity of light beam are controlled so that the diameter and the intensity satisfy the following relations (1), (2) and (3) within the range of the reflection optical density of an image to be formed after developing of from larger than 0.8 to 3.0;

(1) the value of $\alpha$ is substantially the same as the value of $\beta$ when $\alpha = I_{d1} \times D_{d1}^2$ and $I'_{d1} \times D_{0.8}$, and (2) $D_{d1} < D_{0.8}$ (3) $(D_{d2} - D_{d1})/(d_2 - d_1) < 0$ wherein $I_{d1}$ and $D_{d1}$ are each intensity and diameter of light beam to form an image having relection optical density of $d_1$; $D_{0.8}$ is the diameter of light beam to form an image having density of 0.8; $I'_{d1}$ is intensity of the light beam to form an image having a density of $d_1$ when the diameter of the light beam is fixed at $D_{0.8}$; $d_1$ is reflection optical density of image of larger than 0.8 and not larger 3.0 and $d_2$ is reflection optical density of image of larger than $d_1$ and not larger than 3.0.

2. The method of claim 1, wherein light beam is a laser light beam.

3. The method of claim 1, wherein the scanning pitch of the light beam is smaller than the effective diameter of the light beam and the overlap width of rasters is from 30% to 95% of the effective diameter of the light beam.

4. The method of claim 1, wherein the photographic image forming medium is a silver halide photographic light-sensitive material having a silver halide emulsion layer.

5. The method of claim 4, wherein the temperature of the silver halide photographic light-sensitive material at the exposure step is a temperature of from 30° C. to 100° C. and an accuracy of the temperature is ±3° C.

6. The method of claim 4, wherein the silver halide photographic light-sensitive material has a fundamental γ of from 1.0 to 3.5 when the silver halide photographic light-sensitive material is exposed for a time of not more than $1\times10^{-5}$ seconds.

7. The method of claim 4, wherein the silver halide emulsion layer of the photographic light-sensitive material contains two or more kinds of silver halide emulsion different in the sensitivity thereof from each other, and a content of electron trapping metal compound and a content of a hole trapping metal compound each contained in two kinds of the silver halide emulsion having near sensitivity satisfy the following relation (4);

(4) $1 \leqq ((L1)+(L2))\times(RL)^{-3})/((H1)+(H2))\times(RH)^{-3}) \leqq 30$ wherein L1 is an added amount of the electron trapping metal compound in moles/mole of silver in the silver halide emulsion having a lower sensitivity, L2 is an added amount of the hole trapping metal compound in moles/mole of silver in the silver halide emulsion having a lower sensitivity, RL is an average grain diameter of the silver halide emulsion having a lower sensitivity, H1 is an added amount of the electron trapping metal compound in moles/mole of silver in the silver halide emulsion having a higher sensitivity, H2 is an added amount of the hole trapping metal compound in moles/mole of silver in the silver halide emulsion having a higher sensitivity, RL is an average grain diameter of the silver halide emulsion having a higher sensitivity, and L1, L2, H1 and H2 are all not zero.

8. The method of claim 4, wherein the developing step is a color developing step and the treating time of the color developing step is from 1 second to 25 seconds.

9. The method of claim 4, wherein the total amount of silver halide contained in the silver halide photographic light-sensitive material is from 0.001 $g/m^2$ to 0.3 $g/m^2$ and the developing step is carried out by an amplifying development.

* * * * *